US010186806B2

(12) United States Patent
Naemura

(10) Patent No.: US 10,186,806 B2
(45) Date of Patent: Jan. 22, 2019

(54) ELECTRICAL CONNECTOR

(71) Applicant: J.S.T. Mfg. Co., Ltd., Osaka-shi (JP)

(72) Inventor: Ryo Naemura, Osaka (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 0 days.

(21) Appl. No.: 15/535,587

(22) PCT Filed: Oct. 15, 2015

(86) PCT No.: PCT/JP2015/079122
§ 371 (c)(1),
(2) Date: Jun. 13, 2017

(87) PCT Pub. No.: WO2016/103861
PCT Pub. Date: Jun. 30, 2016

(65) Prior Publication Data

US 2017/0352979 A1 Dec. 7, 2017

(30) Foreign Application Priority Data

Dec. 26, 2014 (JP) ..... 2014-265593

(51) Int. Cl.
*H01R 13/15* (2006.01)
*H01R 13/629* (2006.01)
(Continued)

(52) U.S. Cl.
CPC ..... *H01R 13/629* (2013.01); *H01R 12/73* (2013.01); *H01R 12/778* (2013.01); *H01R 12/79* (2013.01)

(58) Field of Classification Search
CPC ..... H01R 12/88; H01R 13/193
(Continued)

(56) References Cited

U.S. PATENT DOCUMENTS 7,094,093 B2 * 8/2006 Nakano ..... H01R 12/771 439/495
7,399,193 B1 * 7/2008 Ho ..... H01R 13/62988 439/260
(Continued)

FOREIGN PATENT DOCUMENTS

JP 2013-157108 A1 8/2013

OTHER PUBLICATIONS

International Search Report for International Application No. PCT/JP2015/079122 dated Nov. 17, 2015.

*Primary Examiner* — Xuong Chung Trans
(74) *Attorney, Agent, or Firm* — Kratz, Quintos & Hanson, LLP

(57) ABSTRACT

Provided is an electrical connector that allows a contact and a member that is to be connected to the contact to be brought into contact with each other in a more uniform manner, realizes more reliable insulation from a board, and achieve a reduction in height.

A partner connection member 4 that is displaced in an insertion direction D1 is inserted into a fitting portion 25 of a housing 6 of an electrical connector 3. A contact 5 is fitted into the fitting portion 25 by being displaced relative to the housing 6 in a direction that is parallel with the insertion direction D1. The contact 5 includes: a first contact portion 11 that is configured to be brought into contact with a conducting portion 2*c* of a circuit board 2; a second contact portion 12 that is configured to be brought into contact with a conducting portion 4*b* of the partner connection member 4; and a connecting portion 13 that connects the first contact portion 11 and the second contact portion 12 to each other. The housing 6 is an integrally formed part. A first insulating portion 27 of the housing 6 is located between a straight
(Continued)

portion 14*b* of the connecting portion 13 and an edge portion 2*g* of the circuit board 2 in a thickness direction Z1.

5 Claims, 15 Drawing Sheets

(51) Int. Cl.
*H01R 12/73* (2011.01)
*H01R 12/79* (2011.01)
*H01R 12/77* (2011.01)

(58) Field of Classification Search
USPC ..... 439/260, 492–495
See application file for complete search history.

(56) References Cited

U.S. PATENT DOCUMENTS 7,892,002 B2 * 2/2011 Shen ..... H01R 13/65802 439/260
7,931,491 B2 * 4/2011 Takahashi ..... H01R 4/028 439/495
8,840,411 B2 * 9/2014 Nakano ..... H01R 12/79 439/260
9,070,993 B2 * 6/2015 Honda ..... H01R 12/88

* cited by examiner

ELECTRICAL CONNECTOR

TECHNICAL FIELD

The present invention relates to an electrical connector.

BACKGROUND ART

For example, a backlight device that is provided in a liquid crystal display device or the like has a configuration in which a connection member such as a flexible flat cable (FFC) and a board are connected to each other by an electrical connector (for example, see Unexamined Patent Application Document 1). The electrical connector disclosed in the Document 1 has a plurality of contacts and a housing that holds the contacts. The contacts are arranged at equal intervals in the width direction of the housing.

Each contact has the same configuration. Each contact is inserted into the housing through a hole that is formed in a top surface of the housing and corresponds to the contact, and thus each contact is press-fitted into the housing. The contacts have terminal portions that extend in a direction that is substantially parallel with the top surface of the housing and protrude outward from the housing. The terminal portion is fixed to the surface of the board through soldering or the like. In addition, the contacts are connected to contacts of the FFC, within the housing.

The contacts have U-shaped portions (tongue-like portions) that are open toward the FFC, and the contacts of the FFC are inserted into the tongue-like portions. With the above-described configuration, the terminal portions that are to be connected to the board through soldering and the tongue-like portions that are to be connected to the contacts of the FFC, of the contacts, are lined up in a direction that is parallel with the surface of the board, and therefore the electrical connector has a small thickness. In other words, a reduction in the height of an electrical connector is realized.

CITATION LIST

Patent Document

Unexamined Patent Application Document 1: JP 2013-157108A

DISCLOSURE OF THE INVENTION

Problem to be Solved by the Invention

With the above-described configuration, the contacts are inserted into the housing in the thickness direction of the housing, and thus the contacts are press-fitted into the housing. Therefore, the positions of the contacts relative to the housing are likely to vary with respect to the thickness direction of the housing.

If there are variations in the positions of the contacts held by the housing, with respect to the thickness direction of the housing, the contact positions (the heights of the contact points) of the contacts and the corresponding contacts of the FFC are likely to vary with respect to the thickness direction of the housing. In other words, it is difficult to equalize contact pressure between the contacts and the corresponding contacts of the FFC. As a result, it is difficult to stabilize the state of contact between the contacts and the corresponding contacts of the FFC.

Similarly, if there are variations in the positions of the contacts held by the housing, with respect to the thickness direction of the housing, the positions at which the contacts are in contact with the surface of the board vary with respect to the thickness direction of the housing. In other words, the state of contact (also referred to as "lead co-planarity") between the contacts and the corresponding electrodes on the board varies. As a result, it is difficult to connect the contacts and the board to each other in a uniform manner through soldering.

Note that it is possible to provide the housing with positioning portions for determining the positions of the contacts in the thickness direction of the housing. However, regarding electrical connectors for which there is strong demand for a reduction in the height, it is not preferable that the housing is provided with the above-described positioning portions because such a configuration leads to an increase in the thickness of the electrical connector.

In view regarding an electrical connector, there is demand for realizing more reliable insulation of the contacts from the board in order to prevent the contacts from causing a short circuit with an unintended portion of the board. In particular, if a component that generates heat at a relatively high temperature, such as an LED (a light emitting diode), is to be mounted on a board, a circuit board that is made of metal is used in some cases, in order to improve heat radiation performance. A circuit board that is made of metal is formed by stacking an insulating layer, a conducting layer, and an insulating layer on the mounting surface of a metal board.

In view regarding a board that is made of metal, a hollowed-out portion is formed by hollowing out one edge portion of the board in some cases, in order to reduce the total thickness of the board and the electrical connector attached to the board (in order to realize a reduction in height). If this is the case, the electrical connector is located in the hollowed-out portion. If a hollowed-out portion is to be formed, an insulating layer, a conducting layer, and an insulating layer are usually stacked on a board that is made of metal, and then the hollowed-out portion is formed by hollowing out the board. If a hollowed-out portion is formed, the cross section of the edge of the hollowed-out portion is a cross section on which an insulating treatment has no effect, and from which a conductive portion is exposed. Usually, such a cross section is not to be subjected to insulating treatment again in order to reduce costs.

Regarding an electrical connector that is to be connected to such a metal board, there is demand for a configuration that makes it possible to ensure insulation (a sufficiently large creepage distance) between the contacts of the electrical connector and the edge of the hollowed-out portion of the board.

In view of the above-described situation, the present invention aims to provide an electrical connector that allows a contact and a member that is to be connected to the contact to be brought into contact with each other in a more uniform manner, realizes more reliable insulation from the board, and achieves a reduction in height.

Means for Solving the Problem (1) An electrical connector according to one aspect of the present invention for achieving the above-described aim is an electrical connector including: a housing that includes a fitting portion that extends in a predetermined insertion direction, and is configured to allow a partner connection member to be inserted into the fitting portion in the insertion direction; and a contact that is configured to be displaced relative to the housing in a parallel direction that is parallel with the insertion direction so that at least a portion of the contact is inserted into the fitting portion and is held by the housing. The contact includes: a first contact portion that is configured to be brought into contact with a conducting portion of a predetermined board; a second contact portion that is located so as to be separated from the first contact portion in the parallel direction, and is configured to be brought into contact with a conducting portion of the partner connection member that is inserted into the fitting portion; and a connecting portion that connects the first contact portion and the second contact portion to each other, and the housing includes: a housing main body on which the fitting portion is formed; and a first insulating portion that is formed integrally with the housing main body, and is configured to be located between the connecting portion and the board in a housing thickness direction that is orthogonal to the insertion direction.

With this configuration, the direction in which the contact is inserted into the fitting portion of the housing is parallel with the insertion direction in which the partner connection member is inserted into the housing. With such a configuration, the contact is inserted into the housing, in the state of being positioned in the thickness direction of the housing relative to the fitting portion. Therefore, it is possible to prevent the relative positions of the contact and the housing from varying in the thickness direction of the housing. As a result, it is possible to prevent the contact position of the contact and the corresponding conducting portion of the partner connection member from varying in the thickness direction of the housing. That is to say, the contact pressure between the contact and the corresponding conducting portion can be substantially uniform. Therefore, it is possible to further stabilize the contact state between the contact and the conducting portion. Furthermore, it is possible to prevent the contact position of the contact and the board from varying in the thickness direction of the housing. As a result, it is possible to prevent the state of contact between the contact and the corresponding conducting portion of the board from varying, and thus it is possible to allow the contact and the conducting portion of the board to be connected to each other in a more uniform manner.

The first insulating portion of the housing is located between the connecting portion of the contact and the board in the housing thickness direction. With this configuration, the first insulating portion can insulate a portion of the board where insulation from the contact has to be secured, and the contact from each other. Therefore, it is possible to more reliably realize the insulation of the portion of the board where insulation from the contact has to be secured, and the contact from each other. In addition, since the first insulating portion is located between the connecting portion of the contact and the board, it is possible to arrange the board and the connecting portion so as to be close to each other in the thickness direction of the housing while preventing a short circuit. As a result, it is possible to reduce the length of the electrical connector and the board in the thickness direction (to realize a reduction in height) in a situation where the electrical connector and the board are connected to each other. Also, the first contact portion and the second contact portion of the contact are lined up in a direction that is parallel with the insertion direction. As a result, it is possible to reduce the length of the contact in the thickness direction that is orthogonal to the insertion direction. That is to say, it is possible to achieve a reduction in the height of the electrical connector.

As described above, the present invention can provide an electrical connector that allows a contact and a member that is to be connected to the contact to be brought into contact with each other in a more uniform manner, realizes more reliable insulation from the board, and achieves a reduction in height.

(2) Preferably, the connecting portion of the contact includes: a first portion that faces the first insulating portion in the thickness direction and is continuous with the first contact portion; and a second portion that is located beside the first insulating portion in a housing width direction that is orthogonal to both the insertion direction and the thickness direction, and connects the first portion and the second contact portion to each other.

With this configuration, the connecting portion of the contact can be formed in a shape that includes an L-like portion. With such a configuration, the first insulating portion can more reliably insulate the first portion of the connecting portion of the contact and the board from each other while reducing the length of the contact in the thickness direction of the housing. That is to say, it is possible to more reliably achieve a reduction in the height and to secure the insulation properties of the electrical connector.

(3) More preferably, the housing includes an insertion hole portion that is formed beside the first insulating portion in the width direction, and is configured to allow the second contact portion to be inserted into the fitting portion in a direction that is opposite the insertion direction.

With this configuration, it is easy to fit the contact into the housing through the insertion hole in the direction that is opposite the insertion direction.

(4) Preferably, the housing includes a reinforcement rib that is continuous with the first insulating portion and the housing main body.

With this configuration, the reinforcement rib is provided, and therefore it is possible to improve the rigidity of the first insulating portion. In particular, in a multipole electrical connector for which there is strong demand for a reduction in height, in the case of a housing that is elongated in the width direction of the housing, it is possible to improve the rigidity, such as the flexural rigidity, of the entire housing including the first insulating portion.

(5) Preferably, the housing includes a second insulating portion that is formed integrally with the housing main body and the first insulating portion, and the second insulating portion is located so as to separate the connecting portion and the board from each other in the parallel direction.

With this configuration, the second insulating portion is located between the connecting portion of the contact and the board, and therefore it is possible to arrange an edge portion of the board and the connecting portion so as to be close to each other in the direction that is parallel with the insertion direction while securing insulation properties. Therefore, it is possible to make the electrical connector and the board more compact overall.

Effects of the Invention

The present invention can provide an electrical connector that allows a contact and a member that is to be connected to the contact to be brought into contact with each other in a more uniform manner, realizes more reliable insulation from the board, and achieves a reduction in height.

DESCRIPTION OF EMBODIMENTS

The following describes embodiments for carrying out the present invention with reference to the drawings. Note that the present invention is broadly applicable to various purposes as an electrical connector.

Figure 1:
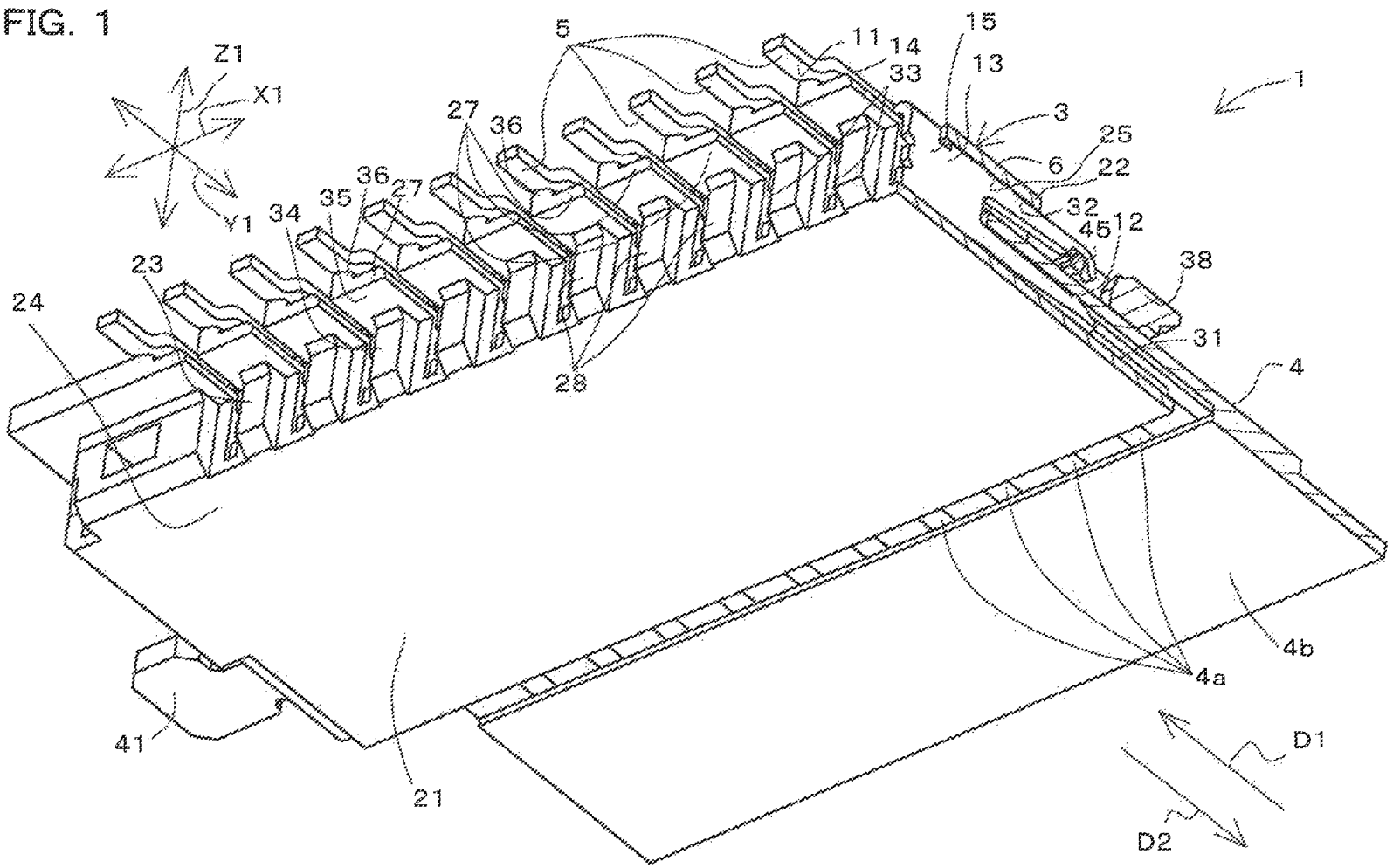
FIG. 1 is a perspective view showing an electrical connector according to an embodiment of the present invention and a partner connection member that are partially cut out, and is a view of a bottom wall portion side of the electrical connector.
Figure 2:
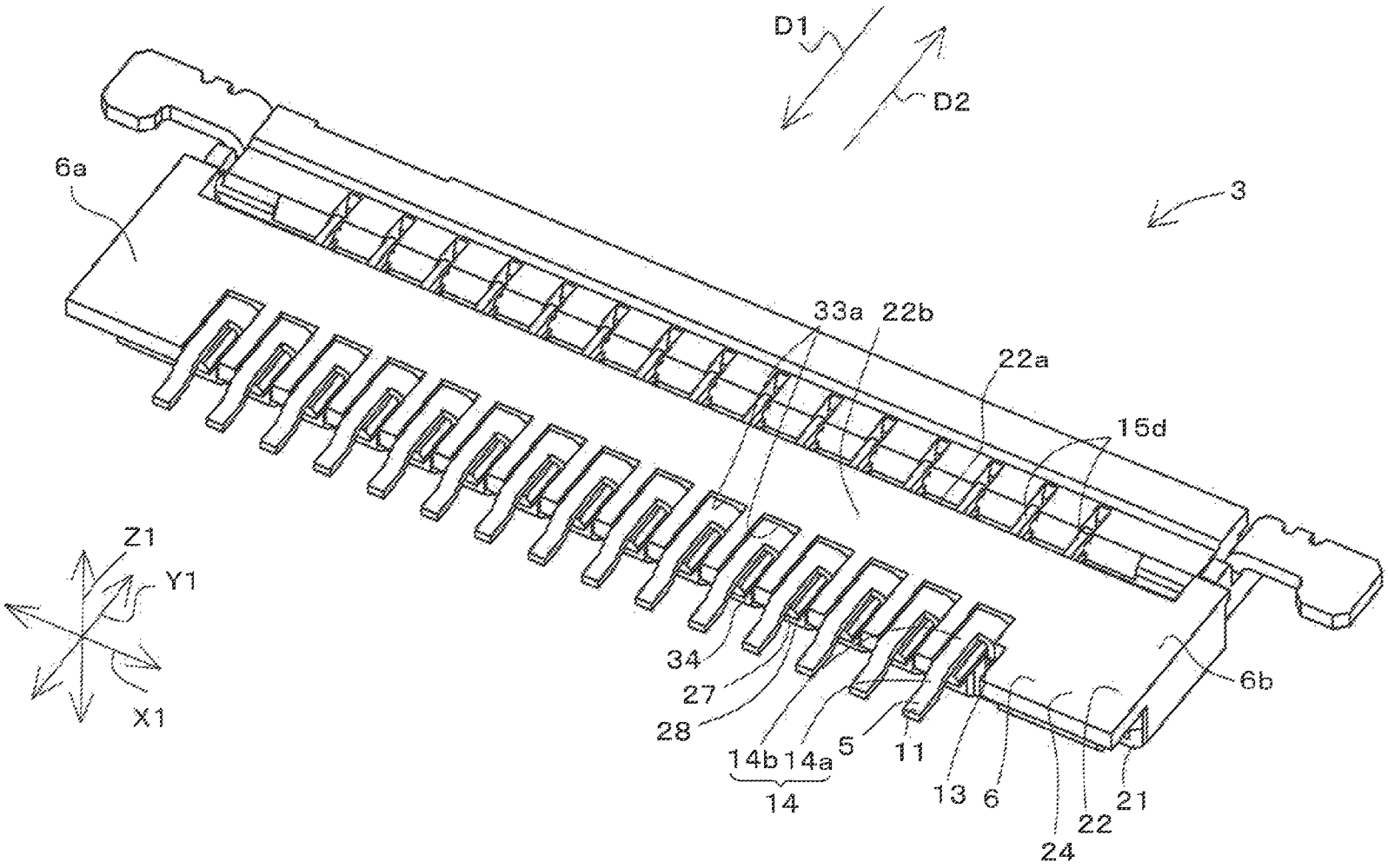
FIG. 2 is a perspective view of the electrical connector, and is a view of a top wall portion side of the electrical connector.
Figure 3:
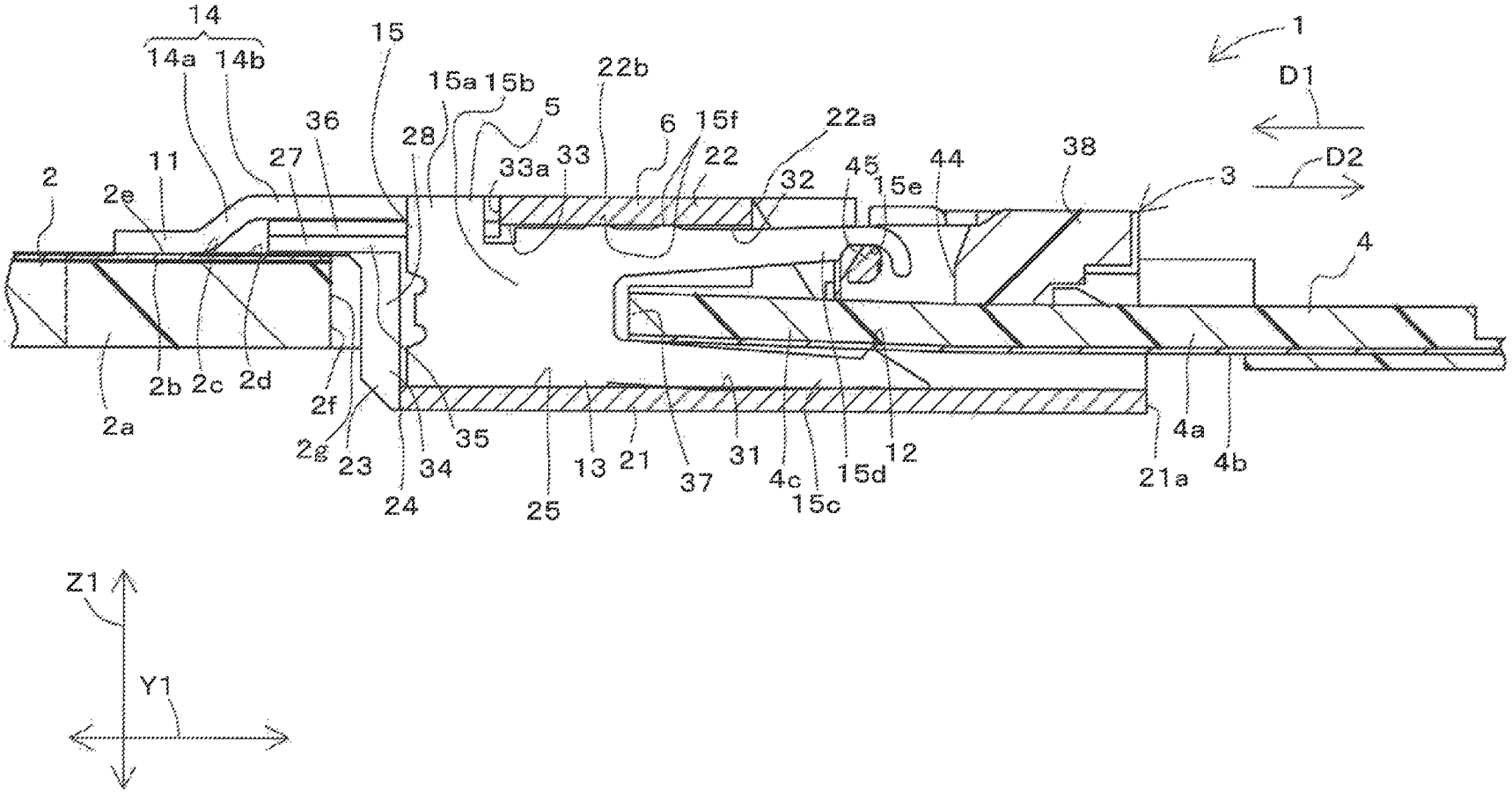
FIG. 3 is a cross-sectional view of an electrical device module that includes the electrical connector.
Figure 4:
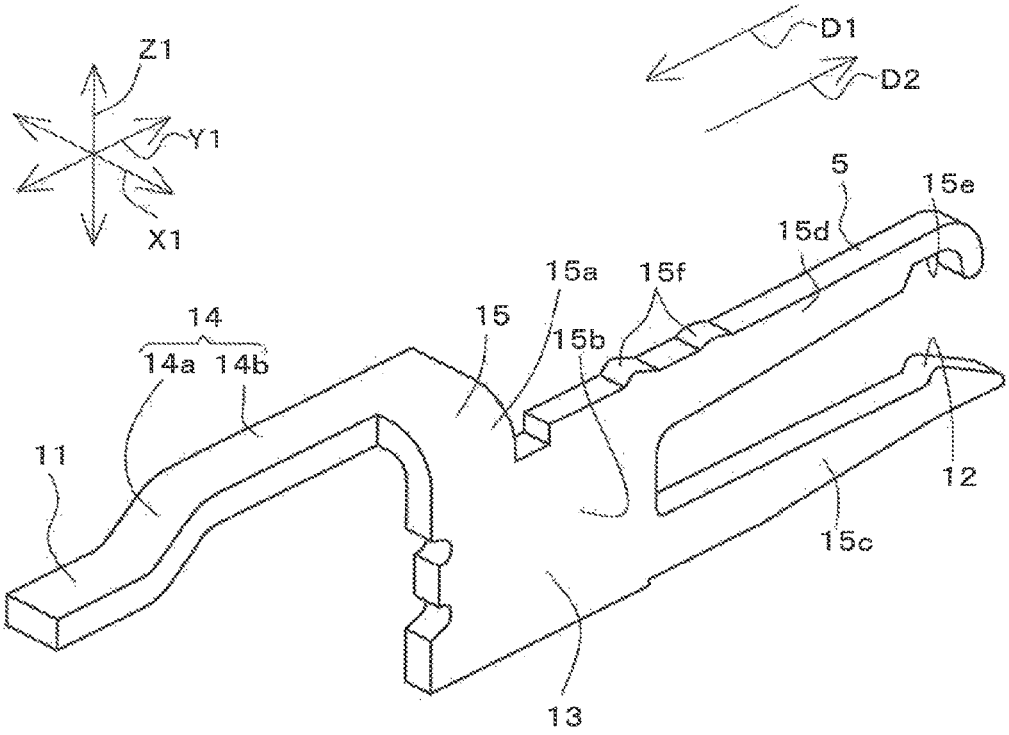
FIG. 4 is a perspective view of a contact of the electrical connector.

FIG. 1 is a perspective view showing an electrical connector 3 according to an embodiment of the present invention and a partner connection member 4 that are partially gut out, and is a view of a bottom wall portion 21 side of the electrical connector 3. FIG. 2 is a perspective view of the electrical connector 3, and is a view of a top wall portion 22 side of the electrical connector 3. FIG. 3 is a cross-sectional view of an electrical device module 1 that includes the electrical connector 3. FIG. 4 is a perspective view of a contact 5 of the electrical connector 3. Note that, regarding drawings that show the electrical connector 3, portions that repeatedly appear are omitted from some of the drawings.

As shown in FIGS. 1 to 3, the electrical device module 1 is provided as, for example, a part of a backlight device of a liquid crystal display device, and is located on the rear side of a liquid crystal panel (not shown) of the liquid crystal display device. Note that the electrical device module 1 (the electrical connector 3) is applicable to not only a backlight device of a liquid crystal panel, but also to various devices. The electrical device module 1 is located in a space that has a small thickness, such as a space on the rear side of the liquid crystal panel. Therefore, the electrical device module 1 is configured such that the thickness that is to be occupied by the electrical device module 1 is reduced as much as possible. The following provides a more specific description.

The electrical device module 1 includes a circuit board 2, the electrical connector 3, and the partner connection member 4.

The circuit board 2 has a configuration in which an insulating layer 2*b*, conducting portions 2*c*, and an insulating layer 2*d* are formed on a main portion 2*a* that is a metal plate or the like. That is to say, the circuit board 2 includes the main portion 2*a* that has a flat shape, the insulating layer 2*b*, the plurality of conducting portions 2*c* that are arranged parallel (only one conducting portion 2*c* is shown in the drawing), and the insulating layer 2*d*. Note that, in FIG. 3, the insulating layers 2*b* and 2*d* and the conducting portions 2*c* are magnified. Also note that, unless otherwise indicated, the following description is provided based on a situation in which the circuit board 2 and the partner connection member 4 are connected to the electrical connector 3.

Also note that, in the following description, a direction X1 of the width of the electrical connector 3 is simply referred to as "the width direction X1", a length direction Y1 that is orthogonal to the direction X1 of the width of the electrical connector 3 is simply referred to as "the length direction Y1", and a thickness direction Z1 that is orthogonal to the width direction X1 and the length direction Y1 is simply referred to as "the thickness direction Z1".

The main portion 2*a* is formed using a metal material that has high thermal conductivity, such as aluminum. The insulating layer 2*b* is formed on the outer surface (the upper surface) of the main portion 2*a*. Thus, the main portion 2*a* is insulated from the conducting portions 2*c*. A large part of the surface (the upper surface) of each conducting portion 2*c* is covered by the insulating layer 2*d*. Electrodes 2*e* are respectively formed on the conducting portions 2*c*, and the electrodes 2*e* are exposed from the insulating layer 2*d*. The conducting portions 2*c* are connected to an LED (Light Emitting Diode) (not shown). That is to say, an LED is mounted as a load on the surface of the circuit board 2. The plurality of electrodes 2*e* are arranged on the circuit board 2 in the width direction X1 of the electrical connector 3 at equal intervals.

One edge portion side of the circuit board 2 includes a hollowed-out portion 2*f* that is formed by hollowing out the circuit board 2 such that the hollowed-out portion 2*f* penetrates through the circuit board 2 in the thickness direction of the circuit board 2. A portion of the electrical connector 3 is housed within the hollowed-out portion 2*f*, and thus the total thickness (the length in the thickness direction Z1) of the electrical device module 1 is reduced (small). That is to say, the height of the electrical device module 1 is reduced.

An edge portion 2*g* (a surface of the circuit board 2, the surface facing a second insulating portion 28, which will be described later, of the electrical connector 3) of the hollowed-out portion 2*f* has not been subjected to insulating treatment. The following are reasons. In a case where the hollowed-out portion 2*f*, of the circuit board 2 that is made of metal, is formed so as to reduce the height of the electrical device module 1, the hollowed-out portion 2*f* is usually formed by first forming the insulating layer 2*b*, the conducting portions 2*c*, and the insulating layer 2*d* on the main portion 2*a* of the circuit board 2 that is made of metal, and then stamping out a portion of the circuit board 2.

Since the hollowed-out portion 2*f* is formed in such a manner, the conducting portions 2*c* are exposed from the edge portion 2*g* of the hollowed-out portion 2*f*. Usually, the edge portion 2*g* is not to be subjected to an insulating treatment again, in order to reduce costs.

The electrical connector 3 is located in the hollowed-out portion 2*f* of the circuit board 2, and connects the circuit board 2 and the partner connection member 4 to each other. The partner connection member 4 is used to connect a power supply circuit (not shown) and the circuit board 2 to each other, for example. In the present embodiment, the partner connection member 4 is an FFC (flexible flat cable), and is flexible. Note that the partner connection member 4 is not limited to an FFC, and may be another member that is electrically connectable to the electrical connector 3, such as an FFC (Flexible Printed Circuit) or a printed circuit board.

The partner connection member 4 includes a covering portion 4*a* and conducting portions 4*b*.

The covering portion 4*a* is a band-like portion that is formed using a synthetic resin or the like, and has a flat shape. The plurality of conducting portions 4*b* are covered by the covering portion 4*a*. The conducting portions 4*b* are arranged within the covering portion 4*a* in the width direction X1 at substantially equal intervals. One end portion of each conducting portion 4*b* is connected to a terminal of a circuit board (not shown) such as a power supply circuit. The other end of each conducting portion 4*b* is exposed from the covering portion 4*a*, at another end portion 4*c* of the covering portion 4*a*.

The partner connection member 4 having the above-described configuration is connected to the electrical connector 3, and is thus electrically connected to the circuit board 2 via the electrical connector 3. Consequently, power from the power supply circuit is supplied to the LED via the partner connection member 4, the electrical connector 3, and the circuit board 2, and the LED turns on. In the present embodiment, the electrical connector 3 is used as a wire-to-board connector that connects the wire (the partner connection member 4) and the board (circuit board 2).

The electrical connector 3 includes contacts 5 that are conductive, and a housing 6 that is insulative and holds the contacts 5.

As shown in FIGS. 1 to 4, the plurality of contacts 5 are arranged in the width direction X1 at substantially equal intervals. The number of contacts 5 are set to be equal to the number of conducting portions 4*b* of the partner connection member 4. The number of contacts 5 is the number of poles of the electrical connector 3. Each contact 5 has the same configuration.

Each contact 5 is a conducting member that is formed by performing pressing (stamping) processing, bending processing, etc. on a metal material that has a surface on which a plated layer is formed, and is an integrally formed part. Each contact 5 is formed in a shape that is elongated in the length direction Y1, and is in contact with the corresponding conducting portion 4*b* of the partner connection member 4, and the electrode 2*e* of the corresponding conducting portion 2*c* of the circuit board 2. Each contact 5 is formed in a substantially y-like shape in side view. Also, each contact 5 is formed in a substantially L-like shape when viewed in the length direction Y1.

Each contact 5 includes a first contact portion 11, a second contact portion 12, and a connecting portion 13.

The first contact portion 11 is provided so as to be brought into contact with the electrode 2*e* of the corresponding conducting portion 2*c* of the circuit board 2. The first contact portion 11 is formed as, for example, a small piece that has a rectangular shape, and constitutes one end portion of the contact 5 in the length direction Y1. The first contact portion 11 is fixed to the electrode 2*e* of the corresponding conducting portion 2*c* of the circuit board 2 through soldering or the like, and can be brought into conduction with the conducting portion 2*c*. The first contact portion 11 is continuous with the connecting portion 13.

The connecting portion 13 is provided so as to connect the first contact portion 11 and the second contact portion 12 to each other. The connecting portion 13 is formed in a substantially U-like shape in side view.

The connecting portion 13 includes a first portion 14 that is continuous with the first contact portion 11, and a second portion 15 that is continuous with the second contact portion 12.

The first portion 14 faces a first insulating portion 27, which will be described later, of the housing 6, in the thickness direction Z1, and is provided as a portion that is continuous with the first contact portion 11. The first portion 14 is formed in a shape that is elongated in the length direction Y1. A portion of the first portion 14 has a curved shape, and thus the first portion 14 is separated from the circuit board 2 in the thickness direction Z1.

More specifically, the first portion 14 includes a first curved portion 14*a* and a straight portion 14*b*.

The first curved portion 14*a* is formed in a substantially S-like shape in side view, and is continuous with the first contact portion 11. The first curved portion 14*a* extends in one way in the thickness direction Z1 (the direction away from the circuit board 2) as the distance from the first contact portion 11 increases. The first curved portion 14*a* is continuous with the straight portion 14*b*. The straight portion 14*b* is located so as to extend substantially straight in the length direction Y1. In the present embodiment, in terms of the length direction Y1, the length of the straight portion 14*b* is longer than the length of the first curved portion 14*a*, and is longer than the length of the first contact portion 11.

The straight portion 14*b* is located so as to straddle the edge portion 2*g* of the hollowed-out portion 2*f* of the circuit board 2. That is to say, the straight portion 14*b* is located so as to line up with the edge portion 2*g* of the hollowed-out portion 2*f* in the thickness direction Z1. The straight portion 14*b* of the first portion 14 lines up with the conducting portion 2*c* that is exposed from the edge portion 2*g*, in the thickness direction Z1.

However, the first insulating portion 27, which will be described later, of the housing 6 is located between the conducting portion 2*c* and the straight portion 14*b* (contact 5). That is to say, the straight portion 14*b* of the first portion 14 and the first insulating portion 27 face each other in the thickness direction Z1. Thus, the first portion 14 and the conducting portion 2*c* are sufficiently insulated from each other (with a sufficiently large creepage distance), and a short circuit between the conducting portions 2*c* and the straight portion 14*b* is prevented from occurring. One end portion of the straight portion 14*b* is continuous with the second portion 15.

The second portion 15 is provided as a portion that connects the first portion 14 and the second contact portion 12 to each other. At least a part (a large part in the present embodiment) of the second portion 15 is located within the housing 6. The second portion 15 is formed in a substantially U-like shape in side view.

The second portion 15 includes a second curved portion 15*a*, a second portion main body 15*b*, and a pair of arm portions 15*c* and 15*d*.

The second portion main body 15*b* constitutes one end portion of the second portion 15 in the length direction Y1. The second portion main body 15*b* is formed in a substantially rectangular shape in side view. The second curved portion 15*a* extends from one edge portion of the second portion main body 15*b*, the one edge portion being adjacent to the straight portion 14*b* of the first portion 14. The second curved portion 15*a* is formed in an L-like shape, and includes a portion that is curved by approximately 90 degrees. The second curved portion 15*a* is continuous with one end portion of the straight portion 14*b*. The second portion main body 15*b* supports the pair of arm portions 15*c* and 15*d*.

The pair of arm portions 15*c* and 15*d* are provided as portions that extend from the second portion main body 15*b* in one way in the length direction Y1. Each of the arm portions 15*c* and 15*d* is supported by the second portion main body 15*b* acting as a cantilever, and is elastically deformable in the thickness direction Z1 so as to pivot about a portion that is supported by the second portion main body 15*b*. The pair of arm portions 15*c* and 15*d* are arranged so as to be separated from each other and face each other in the thickness direction Z1. The pair of arm portions 15*c* and 15*d* are arranged so as to sandwich the other end portion 4*c* of the partner connection member 4. The arm portion 15*c* is located on the side of the bottom wall portion 21, which will be described later, of the housing 6. The arm portion 15*c* is provided with the second contact portion 12.

The second contact portion 12 is configured so as to be brought into contact with the corresponding conducting portion 4*b* of the partner connection member 4 that is inserted into a fitting portion 25, which will be described later, of the housing 6. The second contact portion 12 is a protrusion that is formed near the tip of the arm portion 15*c*, and protrudes toward the other arm portion 15*d*. The second contact portion 12 is located so as to be separated from the first contact portion 11 in the length direction Y1 (the direction that is parallel with an insertion direction D1).

A latch portion 15*e* is formed at a tip portion of the other arm portion 15*d*. The latch portion 15*e* is provided as a portion to which a lock shaft 45 of a lock member 38, which will be described later, is fitted, and is located so as to face the second contact portion 12 in the thickness direction Z1. Also, the other arm portion 15*d* is provided with a press-fitting protrusion 15*f*. The press-fitting protrusion 15*f* is a protruding portion that is provided in order to press-fit the connecting portion 13 of the contact 5 into the corresponding fitting portion 25 of the housing 6, and is formed at one edge portion of the other arm portion 15*d*, the one edge portion being opposite the edge portion that faces the arm portion 15*c*.

Each contact 5 that has the above-described configuration is held by the housing 6 as described above.

Figure 5:
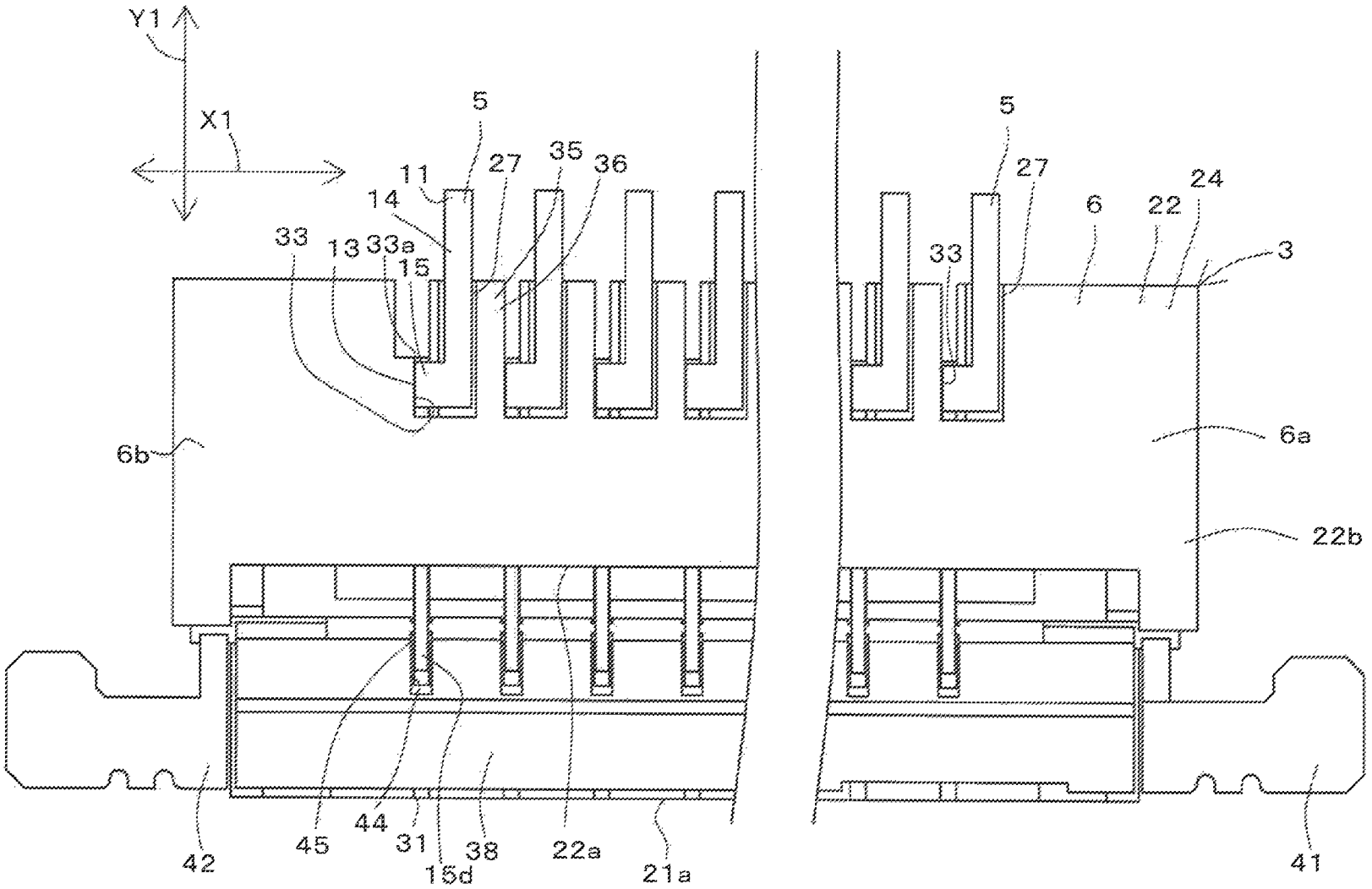
FIG. 5 is a plan view of the electrical connector.
Figure 6:
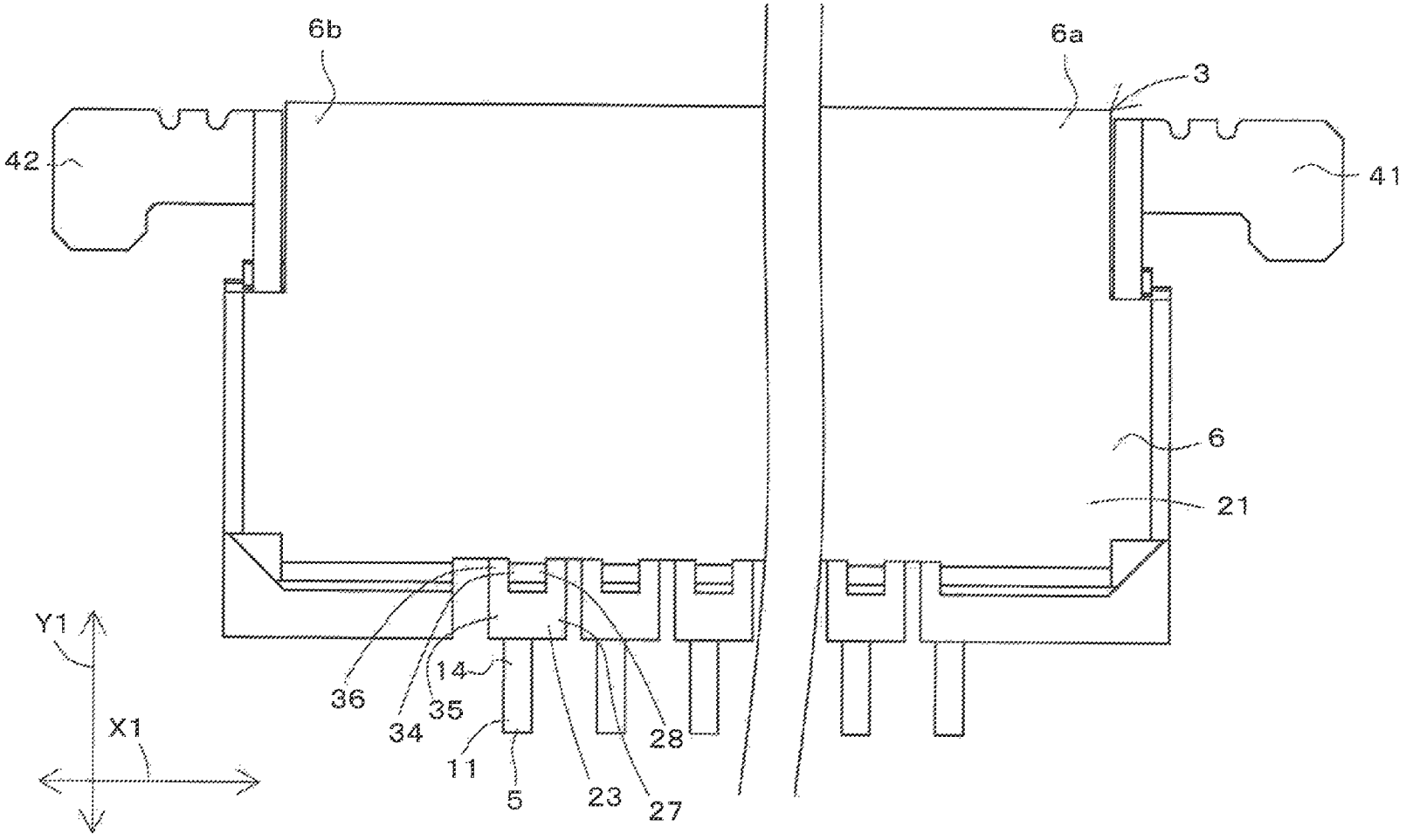
FIG. 6 is a bottom view of the electrical connector.
Figure 7:
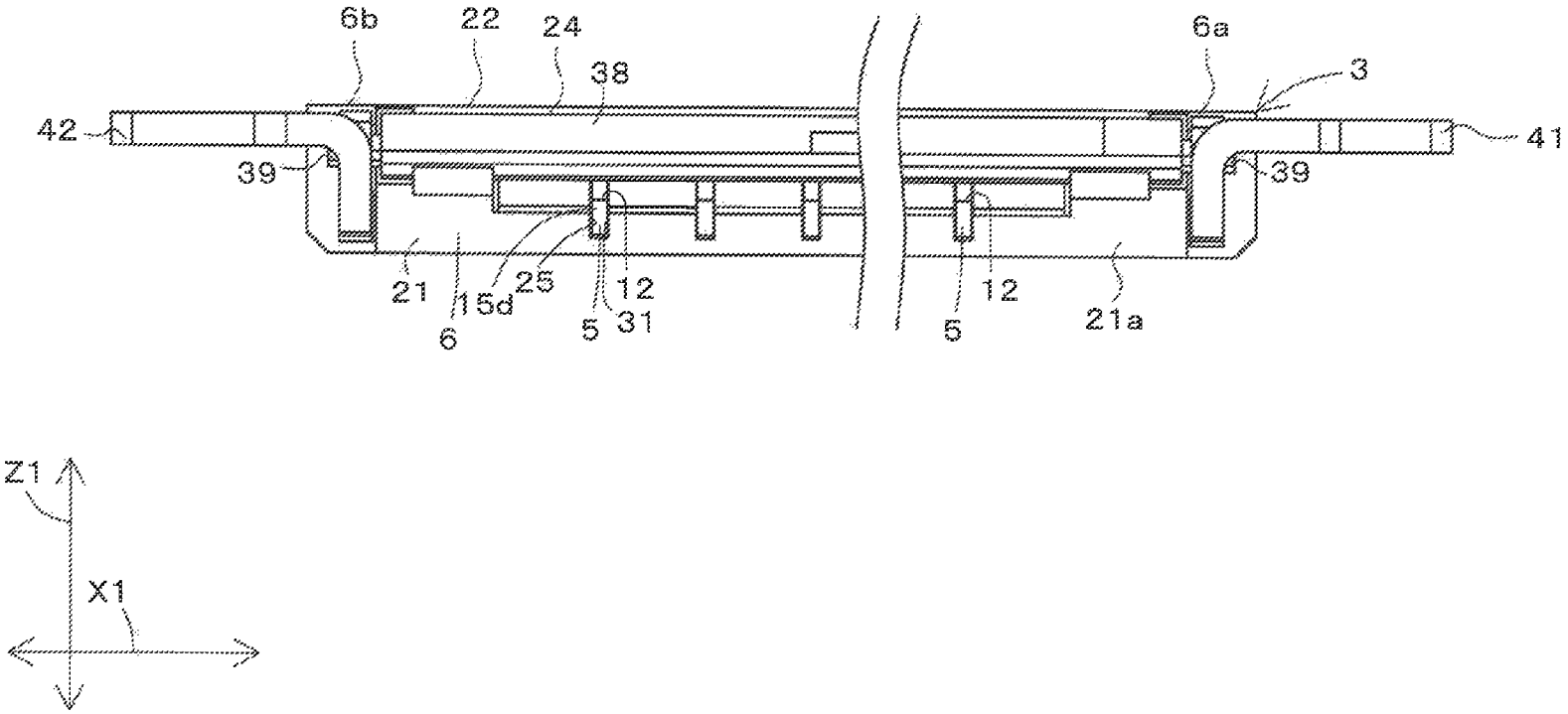
FIG. 7 is a front view of the electrical connector.
Figure 8:
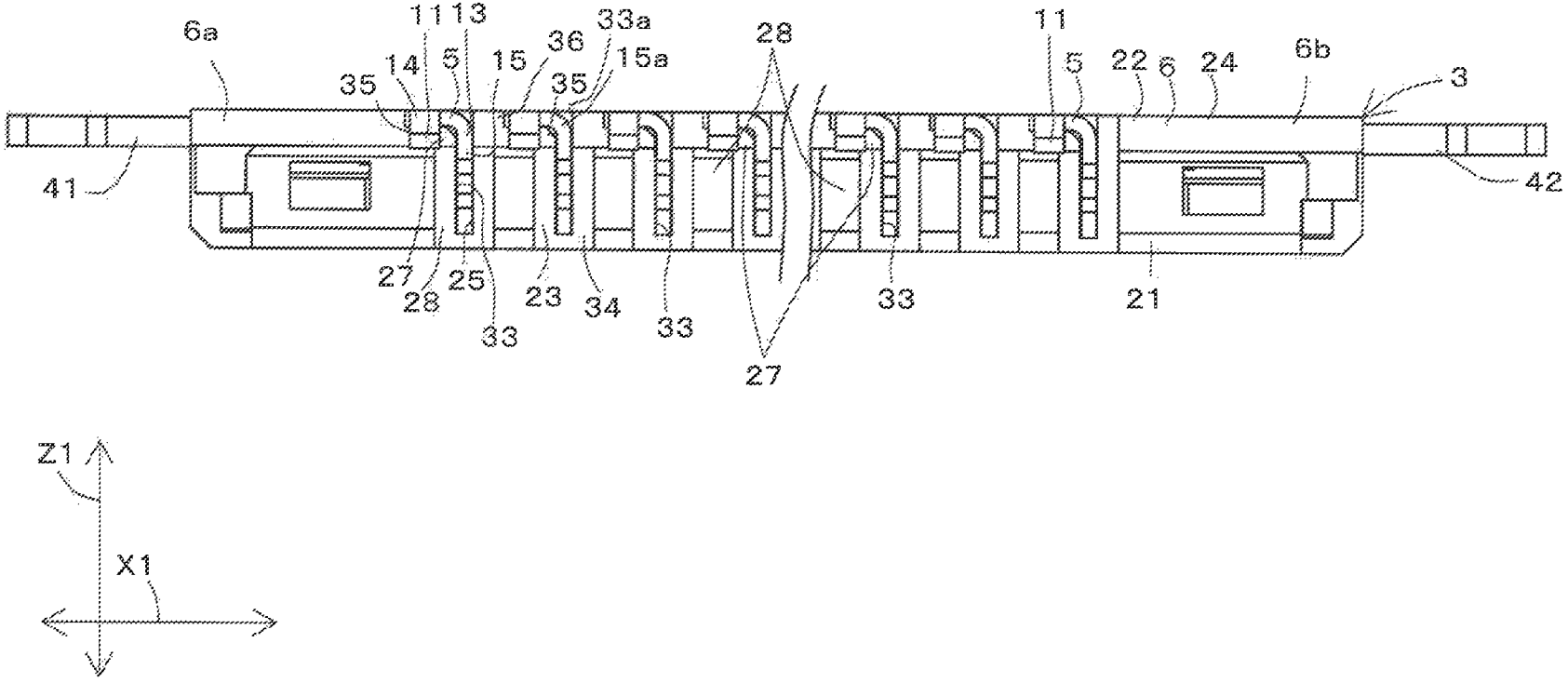
FIG. 8 is a rear view of the electrical connector.
Figure 9:
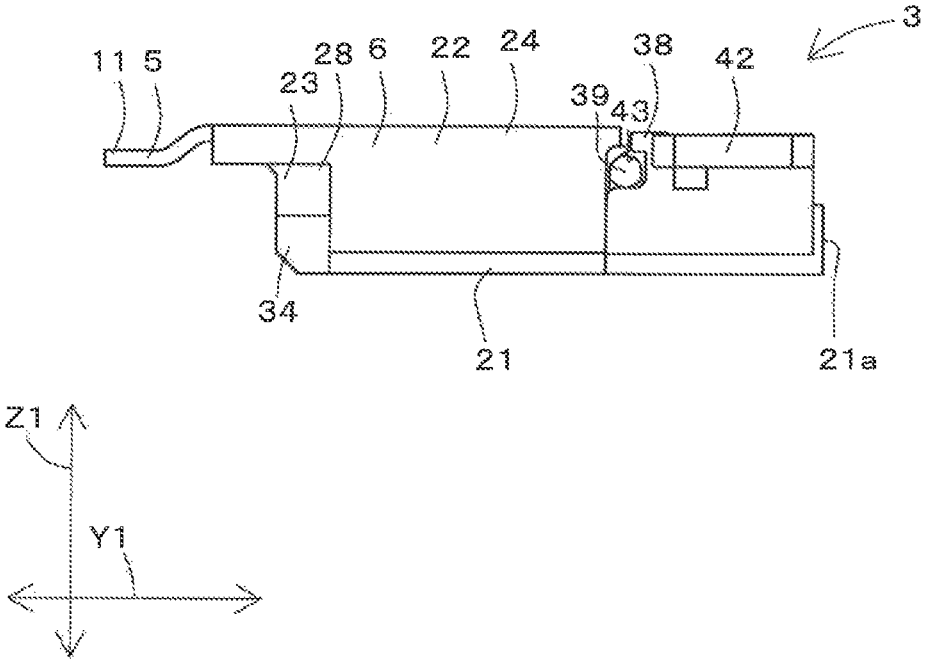
FIG. 9 is a side view of the electrical connector.
Figure 10:
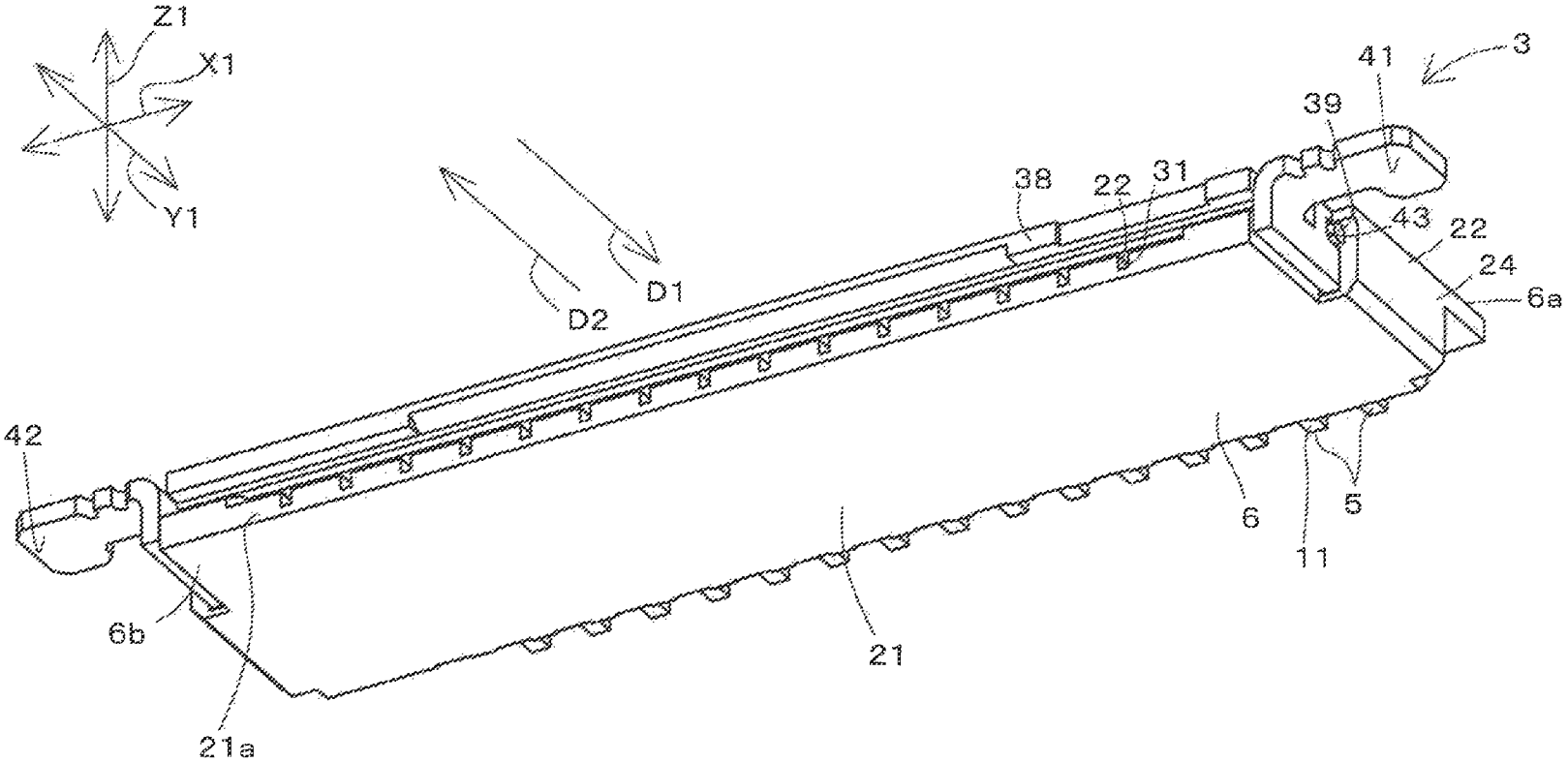
FIG. 10 is a perspective view of the electrical connector, and is a view of the electrical connector from the bottom wall portion side.
Figure 11:
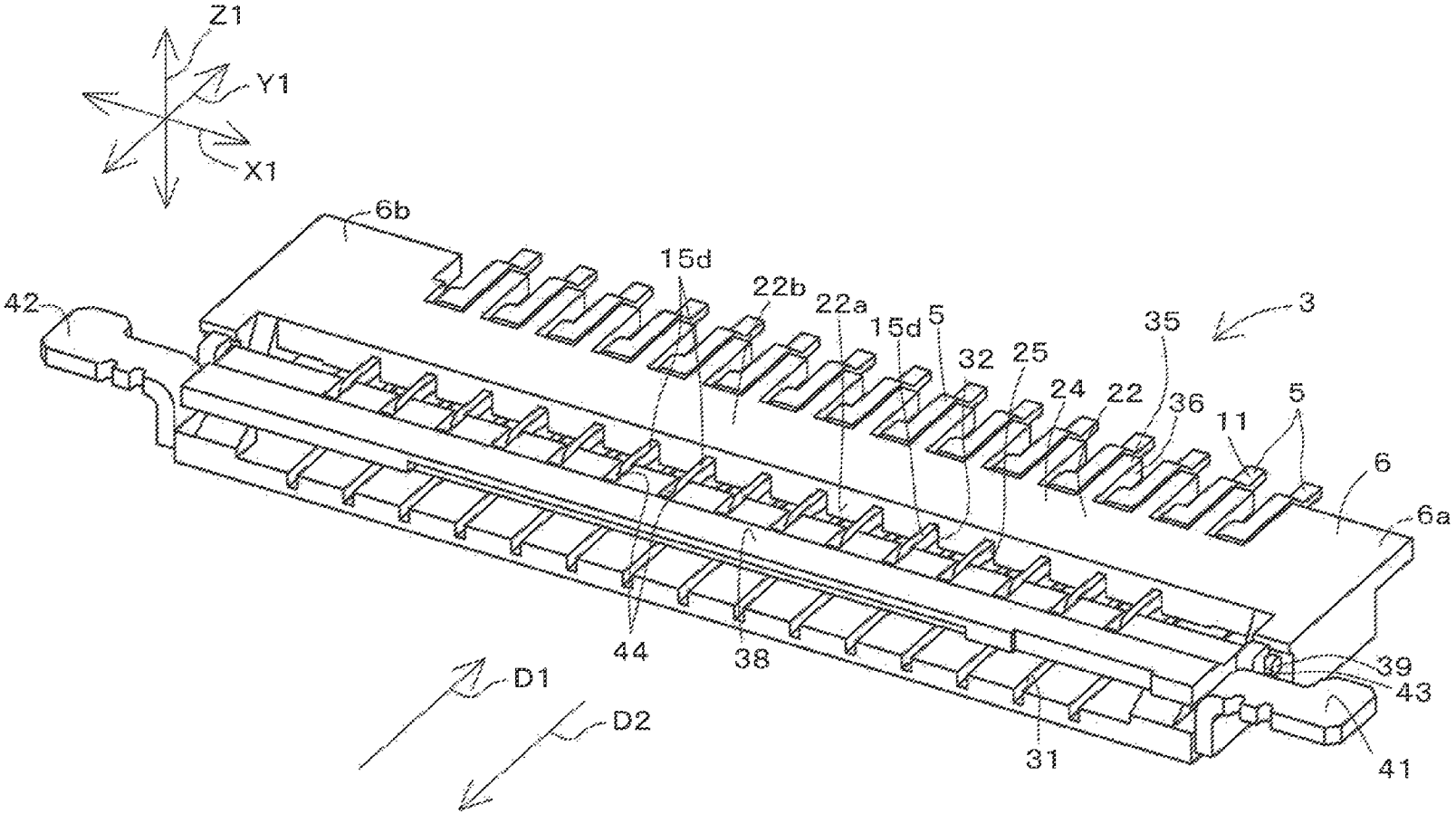
FIG. 11 is a perspective view of the electrical connector, and is a view of the electrical connector from the top wall portion side.
Figure 12:
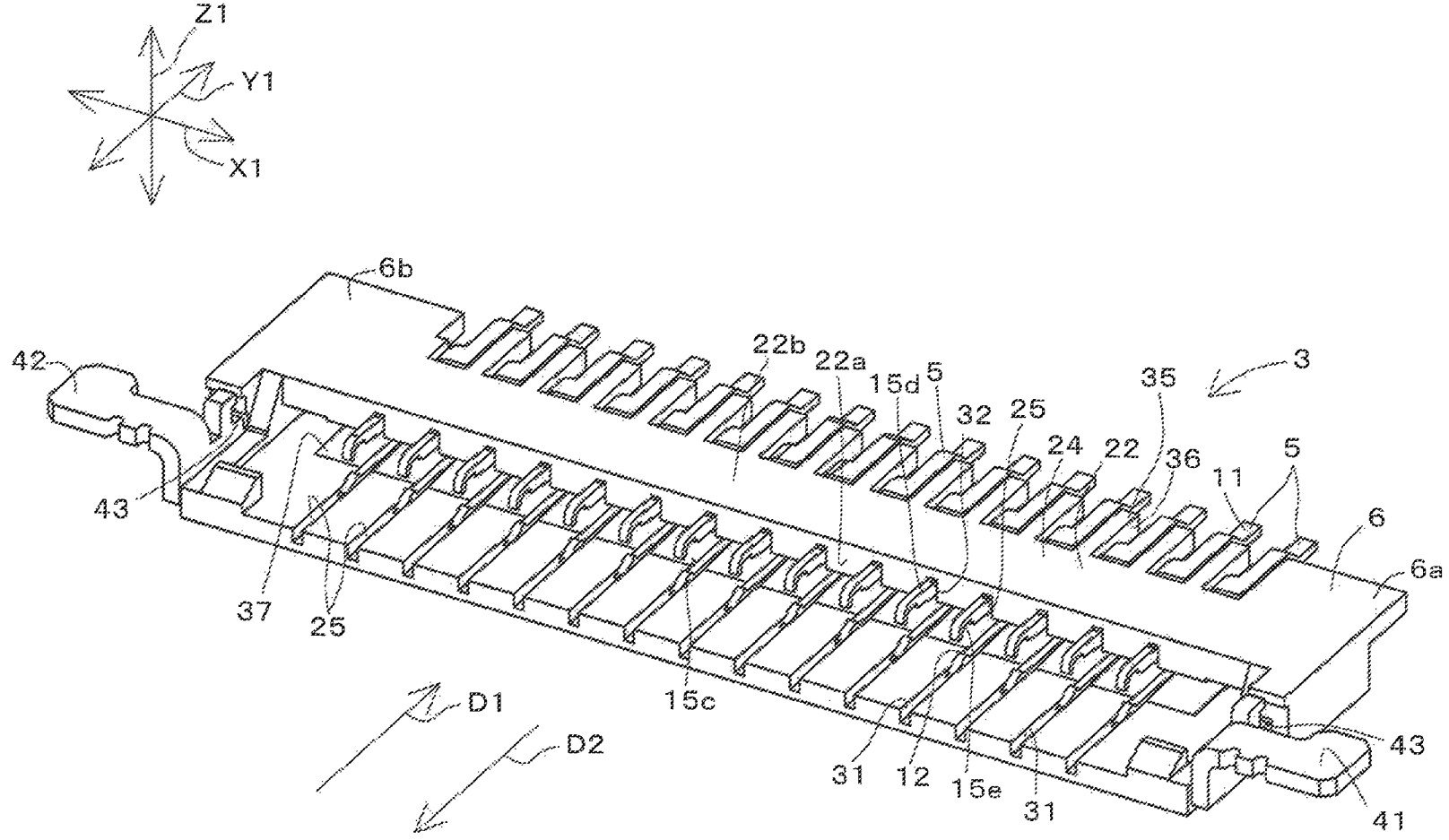
FIG. 12 is a perspective view of the electrical connector, and is a view of the electrical connector from the top wall portion side, from which a lock member is omitted.
Figure 13:
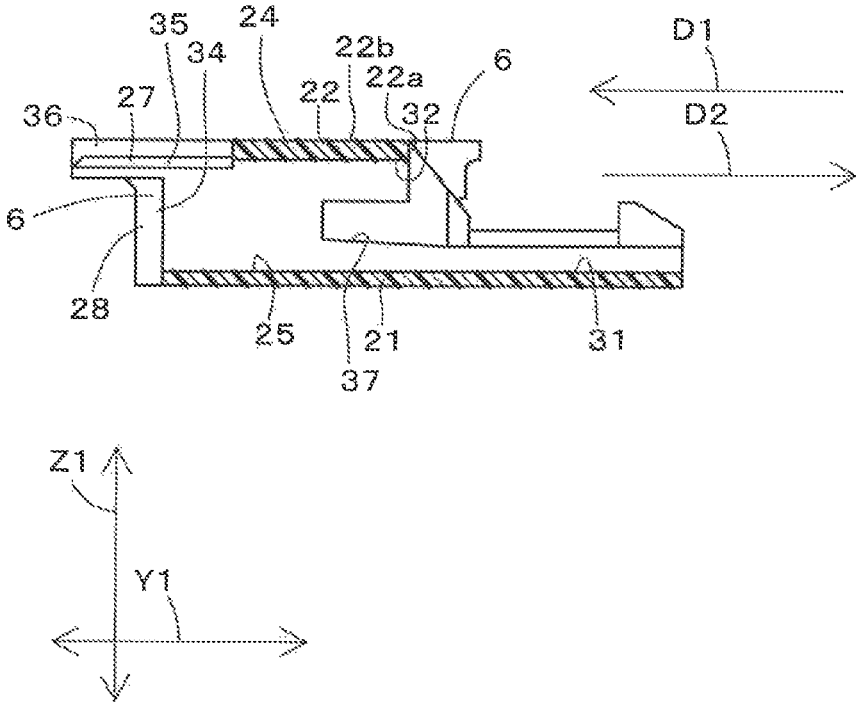
FIG. 13 is a cross-sectional view showing a housing as a single body.

FIG. 5 is a plan view of the electrical connector 3. FIG. 6 is a bottom view of the electrical connector 3. FIG. 7 is a front view of the electrical connector 3. FIG. 8 is a rear view of the electrical connector 3. FIG. 9 is a side view of the electrical connector 3. FIG. 10 is a perspective view of the electrical connector 3, and is a view of the electrical connector 3 from the bottom wall portion 21 side. FIG. 11 is a perspective view of the electrical connector 3, and is a view of the electrical connector 3 from the top wall portion 22 side. FIG. 12 is a perspective view of the electrical connector 3, and is a view of the electrical connector 3 from the top wall portion 22 side, from which the lock member 38 is omitted. FIG. 13 is a cross-sectional view showing the housing 6 as a single body.

As shown in FIGS. 3 and 5 to 13, the housing 6 is an integrally formed part formed using a synthetic resin, and is an insulating member. The housing 6 is a flat member that is formed in a shape that is elongated in the width direction X1 and is thin in the thickness direction Z1. The housing 6 is formed in a rectangular shape that is elongated in the width direction X1 in plan view.

The housing 6 includes: a housing main body 24 that includes the bottom wall portion 21, the top wall portion 22, and a rear portion 23; the fitting portions 25 formed in the housing main body 24; the first insulating portions 27; the second insulating portions 28; and insertion hole portions 33.

The bottom wall portion 21 is provided as a portion that constitutes a bottom surface portion of the electrical connector 3. The bottom wall portion 21 extends in a direction that is orthogonal to the thickness direction Z1. The bottom wall portion 21 is located near a second side surface of the circuit board 2, the second side surface being opposite a first side surface of the circuit board 2 on which the conducting portions 2*c* are formed. The top wall portion 22 is formed so as to face the bottom wall portion 21 in the thickness direction Z1.

The top wall portion 22 is provided as a portion that constitutes a top surface portion of the electrical connector 3. The top wall portion 22 is formed in a rectangular shape that is elongated in the width direction X1 in plan view. Also, the top wall portion 22 is set to be smaller in size than the bottom wall portion 21 in plan view. The top wall portion 22 is located on one end side (the circuit board 2 side) of the bottom wall portion 21 in the length direction Y1, and from which a portion of the bottom wall portion 21 is exposed in plan view. The rear portion 23 is provided so as to connect the top wall portion 22 and the bottom wall portion 21 to each other.

The rear portion 23 is provided on one end portion side of the housing 6 in the length direction Y1, and is located so as to face the edge portion 2*g* of the hollowed-out portion 2*f* of the circuit board 2. The rear portion 23 is formed in a wall-like shape that extends from one end portion 6*a* to another end portion 6*b* of the housing 6 in the width direction X1. The fitting portions 25 are formed along the bottom wall portion 21, the top wall portion 22, and the rear portion 23.

The fitting portions 25 are provided as portions that hold the contacts 5. Also, the fitting portions 25 are provided as portions into which the other end portion 4*c* of the partner connection member 4 is to be inserted. The fitting portions 25 extend in the predetermined insertion direction D1, which is the direction that corresponds to one way in the length direction Y1. The housing 6 is configured such that the other end portion 4*c* of the partner connection member 4 is to be inserted into the fitting portions 25 in the insertion direction D1. When the contacts 5 are displaced relative to the fitting portions 25 in an opposite direction D2 that is parallel (opposite) with the insertion direction D1, at least portions of the contacts 5 are inserted into the fitting portions 25. Thus, the contacts 5 are held by the housing 6.

The plurality of fitting portions 25 are formed on the housing 6 in the width direction X1 at substantially equal intervals. The number of fitting portions 25 is the same as the number of contacts 5. The contacts 5 are respectively held by the corresponding fitting portions 25. Each contact 5 is displaced relative to the corresponding fitting portion 25 and relative to the housing 6 in the direction that is parallel with the insertion direction D1 (in the opposite direction D2 that is opposite the insertion direction D1, the other way in the length direction Y1). Thus, at least a portion of each contact 5 (in the present embodiment, excluding the first contact portion 11, and portions of the straight portion 14*b*, of the contact 5) is inserted into the corresponding fitting portion 25. Each fitting portion 25 has the same configuration.

Each fitting portion 25 includes a bottom groove portion 31 that is formed in the bottom wall portion 21, a top groove portion 32 that is formed in the top wall portion 22, and the insertion hole portion 33 that is formed in the rear portion 23.

The bottom groove portions 31 are groove portions that are formed in the bottom wall portion 21, and extend in the length direction Y1. End portions of the bottom groove portions 31 in the length direction Y1 are continuous with the insertion hole portions 33. The other end portions of the bottom groove portions 31 in the length direction Y1 are open in a front edge portion 21*a* of the bottom wall portion 21. The bottom groove portions 31 are open on the top wall portion 22 side in the thickness direction Z1. The arm portions 15*c* of the contacts 5 are housed in the bottom groove portions 31. Portions on the tip side, and the second contact portions 12, of the arm portions 15*c* are arranged so as to protrude toward the top groove portions 32 from the bottom groove portions 31.

The top groove portions 32 are groove portions that are formed in the top wall portion 22, and extend in the length direction Y1. One end portions of the top groove portions 32 in the length direction Y1 are continuous with the insertion hole portions 33. The other end portions of the top groove portions 32 in the length direction Y1 are open in a front edge portion 22*a* of the top wall portion 22. Base end side portions of the other arm portions 15*d* are housed in the top groove portions 32.

As described above, the length of the top wall portion 22 is shorter than the length of the bottom wall portion 21 in the length direction Y1. Therefore, in plan view, portions of the bottom groove portions 31 are exposed, and tip side portions of the pair of arm portions 15*c* and 15*d* are exposed. The top groove portions 32 are open on the bottom wall portion 21 side in the thickness direction Z1.

Base end side portions of the other arm portions 15*d* of the contacts 5 are housed in the top groove portions 32. Tip side portions of the other arm portions 15*d* protrude from the top groove portions 32. The insertion hole portions 33 are formed so as to connect the top groove portions 32 and the bottom groove portions 31 to each other.

The insertion hole portions 33 are formed beside the first insulating portions 27 in the width direction X1. The insertion hole portions 33 are formed in order to insert the connecting portions 13 and the second contact portions 12 of the contacts 5 into the fitting portions 25 by displacing the connecting portion 13 and the second contact portion 12 of the contacts 5 relative to the housing 6 in the opposite direction D2. The insertion hole portions 33 are formed in the bottom wall portion 21, the top wall portion 22, and the rear portion 23, and extend in the length direction Y1. The insertion hole portions 33 are formed so as to penetrate through the rear portion 23 in the length direction Y1. The insertion hole portions 33 are formed in a shape that is elongated in the thickness direction Z1 when viewed in the length direction Y1.

The second portion main bodies 15*b* of the connecting portions 13 of the contacts 5 are housed in the insertion hole portions 33. Cutouts 33*a* are formed in the insertion hole portions 33. The cutouts 33*a* are formed on one ends of the insertion hole portions 33 in the length direction Y1 (one ends on the circuit board 2 side), at positions that are adjacent to the top wall portion 22, and are open on the top wall portion 22 side. The second curved portions 15*a* of the connecting portions 13 of the contacts 5 are arranged in the cutouts 33*a*. The contacts 5 are held by being press-fitted into the fitting portions 25. Specifically, the press-fitting protrusions 15*f* of the contacts 5 are in contact with the top groove portions 32 and the insertion hole portions 33 of the fitting portions 25, in the state of being subjected to pressure. Edge portions of the second portion main bodies 15*b* of the connecting portions 13 of the contacts 5 are in contact with the bottom groove portions 31, in the state of being subjected to pressure.

The rear portion 23 in which the insertion hole portions 33 are formed as described above includes rear portion main bodies 34 and extension portions 35.

The rear portion main bodies 34 are portions that are located beside the insertion hole portions 33 in the width direction X1 in rear view of the electrical connector 3, and are formed in a block-like shape. On the other hand, the extension portions 35 are formed at end portions of the rear portion main bodies 34 on the top wall portion 22 side in the thickness direction Z1. The extension portions 35 extend from the rear portion main bodies 34 and the top wall portion 22 toward the circuit board 2 in the length direction Y1, and constitute one end portion of the housing 6 in the length direction Y1. In the present embodiment, the extension portions 35 are formed in an L-like shape in rear view.

The extension portions 35 include first insulating portions 27 and reinforcement ribs 36. The rear portion main bodies 34 include second insulating portions 28.

The first insulating portions 27 (the extension portions 35) are firmed integrally with the housing main body 24. The first insulating portions 27 are arranged between the straight portions 14*b* of the first portions 14 of the connecting portions 13 of the contacts 5 and one lateral surface of the circuit board 2 (the mounting surface on which the electrodes 2*e* are formed), in the thickness direction Z1 that is orthogonal to the insertion direction D1. The first insulating portions 27 are respectively provided for the fitting portions 25, and the first insulating portions 27 and the fitting portions 25 are alternatingly arranged in the width direction X1. That is to say, the first insulating portions 27 are formed beside the insertion hole portions 33 in the width direction X1. The first insulating portions 27 are block-like portions that are arranged in the extension portions 35 so as to be adjacent to the straight portions 14*b* of the contacts 5 in the thickness direction Z1.

As described above, the first insulating portions 27 are interposed between the hollowed-out portions 2*f* of the circuit board 2 and the straight portions 14*b* of the contacts 5. Thus, the first insulating portions 27 insulate the conducting portions 2*c* that are exposed from the edge portion 2*g* of the circuit board 2 and the straight portions 14*b* of the contacts 5 from each other, and prevent a short circuit from occurring between the conducting portions 2*c* and the straight portions 14*b*. The length of the first insulating portions 27 is set to be no smaller than the length of the first portions 14 of the contacts 5 in the width direction X1.

The first insulating portions 27 are arranged at positions that are recessed from a top surface 22*b* of the top wall portion 22 of the housing 6 in the width direction Z1. Lateral surfaces of the straight portions 14*b* of the first portions 14 of the contacts 5 are arranged so as to be on substantially the same plane as the top surface 22*b* of the top wall portion 22. Thus, the thickness of the electrical connector 3 is reduced, and a reduction in the height of the electrical connector 3 is achieved. The second portion main bodies 15*b* of the second portions 15 of the connecting portions 13 of the contacts 5 are arranged so as to be adjacent to the first insulating portions 27, in the width direction X1. The first insulating portions 27 are reinforced by the reinforcement ribs 36.

The reinforcement ribs 36 are block-like portions that extend in the length direction Y1. In the present embodiment, the reinforcement ribs 36 and the first insulating portions 27 constitute L-like portions in rear view. The reinforcement ribs 36 are formed as beams that are continuous with both the top surfaces of the first insulating portions 27 and the top wall portion 22 of the housing main body 24. The reinforcement ribs 36 have a height (a length in the thickness direction Z1) that is not so long that the reinforcement ribs 36 protrude from the top surface 22*b* of the top wall portion 22, and thus a reduction in the height of the electrical connector 3 is realized.

In the present embodiment, the straight portions 14*b* of the contacts 5 are arranged so as to be surrounded by the L-like portions constituted by the first insulating portions 27 and the reinforcement ribs 36, and thus each contact 5 is prevented from being brought into contact with another contact 5 upon receiving an external force. The first insulating portions 27 cooperate with the second insulating portions 28 to insulate the conducting portions 2*c* at the edge portion 2*g* of the circuit board 2 and the second portion main bodies 15*b* of the contacts 5 from each other.

The second insulating portions 28 are block-like portions that are formed as portions of the rear portion main bodies 34, and are arranged between the connecting portions 13 of the contacts 5 and the edge portions 2*g* of the circuit board 2 in the insertion direction D1. The second portion main bodies 15*b* of the connecting portions 13 of the contacts 5 are arranged at positions that are separated from the second insulating portions 28 in the length direction Y1. Thus, the second insulating portions 28 prevent the edge portion 2*g* of the circuit board 2 from being brought into contact with the second portion main bodies 15*b* of the connecting portions 13 of the contacts 5, and prevent the distance between the edge portion 2*g* and the second portion main bodies 15*b* from being smaller than a predetermined value. That is to say, the second insulating portions 28 are arranged so as to separate the connecting portions 13 and the edge portion 2*g* of the circuit board 2 from each other in the length direction Y1.

Thus, the second insulating portions 28 secure a sufficient creepage distance between the conducting portions 2*c* at the edge portion 2*g* of the circuit board 2 and the second portion main bodies 15*b* of the connecting portions 13 of the contacts 5, and prevent a short circuit from occurring between the conducting portions 2*c* and the second portion main bodies 15*b*. The second insulating portions 28 are arranged beside the first insulating portions 27 in the thickness direction Z1, and the second insulating portions 28 and the insertion hole portions 33 are alternatingly arranged in the width direction X1.

A partner connection member receiving portion 37 is formed on the housing 6. The partner connection member receiving portion 37 is provided as a portion into which the other end portion 4*c* of the partner connection member 4 is to be inserted. The partner connection member receiving portion 37 is formed by the bottom wall portion 21 and the top wall portion 22 of the housing 6, and is orientated in the opposite direction D2 that is opposite the insertion direction D1. The partner connection member receiving portion 37 is formed in a groove-like shape that is elongated in the width direction X1.

The partner connection member receiving portion 37 penetrates through the plurality of fitting portions 25 in the width direction X1. The thickness (the length in the thickness direction Z1) of the partner connection member receiving portion 37 is set to be no smaller than the thickness of the partner connection member 4. The partner connection member 4 is inserted into the partner connection member receiving portion 37, and thus each conducting portion 4*b* of the partner connection member 4 is inserted between the pair of arm portions 15*c* and 15*d* of the corresponding contact 5, and is brought into contact with the corresponding second contact portion 12. The partner connection member 4 that is inserted into the partner connection member receiving portion 37 is locked by the lock member 38, and is prevented from being removed from the housing 6.

The lock member 38 is formed in a plate-like shape that is elongated in the width direction X1. Shaft portions 39 that extend in the width direction X1 are formed at two ends of the lock member 38 in the width direction X1. The shaft portions 39 are fitted into hole portions 43 that are formed in reinforcement tabs 41 and 42 that will be described later. Thus, the lock member 38 is swingable about the shaft portions 39 relative to the housing 6. A plurality of groove portions 44 are formed in the lock member 38 at substantiality equal intervals in the width direction X1. Each groove portion 44 is formed in a shape that houses the tip of the other arm portion 15*d* of the corresponding contact 5.

As clearly shown in FIG. 3, the lock shaft 45 is formed in each groove portion 44 of the lock member 38. Each lock shaft 45 is a shaft that extends in the width direction X1 in the corresponding groove portion 44, and fitted into the latch portion 15*e* of the other arm portion 15*d* of the corresponding contact 5. Each lock shaft 45 is a cam shaft, and is formed such that the distance from the central axis of the lock shaft 45 to the outer circumferential surface of the lock shaft 45 is non-uniform.

In the present embodiment, in side view, the lock shafts 45 are formed in the shape of a true circle from which a portion of the true circle has been removed. The lock member 38 is arranged substantially parallel with the bottom wall portion 21, and thus the cylindrical portions of the shaft portions 39 lift up the latch portions 15*e* of the other arm portions 15*d* toward the top wall portion 22.

Thus, each pair of arm portions 15*c* and 15*d* is lifted up toward the top wall portion 22. As a result, the second contact portions 12 of the other arm portions 15*d* are pressed against the corresponding conducting portions 4*b* of the partner connection member 4. The partner connection member 4 is fixed by being sandwiched between the second contact portions 12 and the lock member 38, and is restricted from being removed from the housing 6. On the other hand, in the case of unlocking, the lock member 38 is rotated about the shaft portions 39, and thus the lock member 38 is located so as to stand upright relative to the bottom wall portion 21. In this case, the cylindrical portions of the shaft portions 39 are separated from the other arm portions 15*d*, and the lift-up operations of the pairs of arm portions 15*c* and 15*d* are released.

Thus, the lock member 38 lifts up the contacts 5, and the partner connection member 4 is unlocked. As a result, the partner connection member 4 can be inserted into and removed from the housing 6.

Two end portions 6*a* and 6*b*, in the width direction X1, of the housing 6 that has the above-described configuration are provided with the reinforcement tabs 41 and 42. The reinforcement tabs 41 and 42 are substantially L-like members that are made of the similar material as the contacts 5. The hole portions 43 into which the shaft portions 39 of the lock member 38 are to be inserted are respectively formed in the reinforcement tabs 41 and 42. The reinforcement tabs 41 and 42 are fixed to the corresponding end portions 6*a* and 6*b* of the housing 6, and are configured to be fixed to the circuit board 2. Thus, the housing 6 is firmly fixed to the circuit board 2.

As described above, in the electrical connector 3 according to the present embodiment, the direction in which the contacts 5 are inserted into the fitting portions 25 of the housing 6 (the opposite direction D2) is parallel with the insertion direction D1 in which the partner connection member 4 is inserted into the housing 6. With such a configuration the contacts 5 are inserted into the housing 6, in the state of being positioned in the thickness direction Z1 relative to the fitting portions 25. Therefore, it is possible to prevent the relative positions of the contacts 5 and the housing 6 from varying in the thickness direction Z1. As a result, it is possible to prevent the contact positions of the contacts 5 and the corresponding conducting portions 4*b* of the partner connection member 4 from varying in the thickness direction Z1. That is to say, it is possible to substantially equalize the contact pressure between the contacts 5 and the corresponding conducting portions 4*b* of the circuit board 2. Therefore, it is possible to further stabilize the contact state between the contacts 5 and the corresponding conducting portions 4*b* of the circuit board 2. Furthermore, it is possible to prevent the contact positions of the contacts 5 and the corresponding conducting portions 2*c* (electrodes 2*e*) of the circuit board 2 from varying in the thickness direction Z1. As a result, it is possible to prevent the contact state between the contacts 5 and the corresponding conducting portions 2*c* of the circuit board 2 from varying, and it is possible to connect the contacts 5 and the corresponding conducting portions 2*c* of the circuit board 2 to each other in a more uniform manner.

The first insulating portions 27 of the housing 6 are located between the straight portions 14*b* of the connecting portions 13 of the contacts 5 and the edge portion 2*g* of the circuit board 2 in the thickness direction Z1. With this configuration, the first insulating portions 27 can insulate the edge portion 2*g* of the circuit board 2 where insulation from the contacts 5 has to be secured, and the straight portions 14*b* of the contacts 5 from each other. Therefore, it is possible to more reliably realize insulation of the conducting portions 2*c* of the edge portion 2*g* where insulation from the straight portions 14*b* of the contacts 5 has to be secured, from the straight portions 14*b* of the contacts 5. Furthermore, since the first insulating portions 27 are located between the straight portions 14*b* of the connecting portions 13 of the contacts 5 and the circuit board 2, it is possible to arrange the straight portions 14*b* of the connecting portions 13 of the contacts 5 and the circuit board 2 so as to be close to each other in the thickness direction Z1 while preventing a short circuit. As a result, it is possible to reduce the length of the electrical connector 3 and the circuit board 2 in the thickness direction Z1 (to realize a reduction in height) in a situation where the electrical connector 3 and the circuit board 2 are connected to each other. The first contact portions 11 and the second contact portions 12 of the contacts 5 are lined up in the length direction Y1 that is parallel with the insertion direction D1. Therefore, it is possible to reduce the length of the contacts 5 in the thickness direction Z1. That is to say, it is possible to achieve a reduction in the height of the electrical connector 3.

As described above, with the electrical connector 3 according to the present embodiment, the plurality of contacts 5 and the circuit board 2 and the partner connection member 4 that are to be connected to the contacts 5 can be brought into contact with each other in a uniform manner. Also, it is possible to realize more reliable insulation from the circuit board 2, and to achieve a reduction in height.

With the electrical connector 3, the connecting portion 13 of each contact 5 can be formed in a shape that includes an L-like portion (the first portion 14 and the second portion 15) when viewed in the length direction Y1. With such a configuration, it is possible to reduce the length of the contacts 5 in the thickness direction Z1, and it is possible to more reliably insulate the straight portions 14*b* of the first portions 14 of the connecting portions 13 of the contacts 5 and the circuit board 2 by using the first insulating portions 27. That is to say, it is possible to more reliably achieve a reduction in the height and to secure the insulation properties of the electrical connector 3.

In the electrical connector 3, the housing 6 includes the insertion hole portions 33 that are formed beside the first insulating portions 27 in the width direction X1 and allow the second contact portions 12 to be inserted into the fitting portions 25 in the opposite direction D2. With this configuration, it is easy to fit the contacts 5 into the housing 6 through the insertion hole portions 33 in the opposite direction D2. With such a configuration, it is possible to more reliably prevent the positions of the plurality of contacts 5 from varying in the thickness direction Z1.

In the electrical connector 3, the first insulating portions 27 are respectively provided with the reinforcement ribs 36. With this configuration, it is possible to improve the rigidity of each first insulating portion 27. In particular, in the multipole electrical connector 3 for which there is strong demand for a reduction in the height, in the case of the housing 6 that is elongated in the width direction X1, it is possible to improve the rigidity, such as the flexural rigidity, of the entire housing 6 including the first insulating portions 27.

Also, in the electrical connector 3, the second insulating portions 28 of the housing 6 are arranged so as to separate the connecting portions 13 of the contacts 5 and the circuit board 2 from each other in the length direction Y1. With this configuration, the second insulating portions 28 are located between the connecting portions 13 of the contacts 5 and the circuit board 2, and therefore, it is possible to arrange the edge portion 2*g* of the circuit board 2 and the connecting portions 13 so as to be close to each other in the length direction Y1 while securing insulation properties. Therefore, it is possible to make the electrical connectors 3 and the circuit board 2 more compact overall.

In the electrical connector 3, the circuit board 2 has a configuration in which the insulating layer 2*b*, the conducting portions 2*c*, and the insulating layer 2*d* are stacked on the main portion 2*a* that is made of an aluminum alloy. Also, the edge portion 2*g* of the hollowed-out portion 2*f* that is a portion of the circuit board 2 is formed by performing cutting processing. Therefore, the conducting portions 2*c* are exposed at the edge portion 2*g*. In the circuit board 2 having such a configuration, the conducting portions 2*c* at the edge portion 2*g* are located close to the straight portions 14*b* and the second portion main bodies 15*b* of the contacts 5, and are likely to cause a short circuit. However, the first insulating portions 27 and the second insulating portions 28 are located on the housing 6 of the electrical connector 3. As a result, it is possible to more reliably prevent the conducting portions 2*c* at the edge portion 2*g* of the circuit board 2 that is mainly made of an aluminum alloy, the conducting portions 2*c* being exposed at the edge portion 2*g*, from causing a short circuit with the contacts 5. Therefore, the electrical connector 3 is particularly preferable in the case in which it is to be mounted on the circuit board 2 that is mainly made of an aluminum alloy.

In the electrical connector 3, the first insulating portions 27 and the second insulating portions 28 of the housing 6 are formed integrally with the housing main body 24. Therefore, it is possible to reduce the number of parts of the housing 6 compared to the case in which the first insulating portions 27 and the second insulating portions 28 of the housing 6 are formed sing a member that is separate from the housing main body 24, and the first insulating portions 27 and the second insulating portions 28 are attached to the housing main body 24. Therefore, it is possible to reduce the manufacturing cost of the housing 6. Furthermore, by forming the first insulating portions 27 and the second insulating portions 28 of the housing 6 integrally with the housing main body 24, it is possible to reduce individual variations in the positions of the first insulating portions 27 and the positions of the second insulating portions 28 relative to the housing main body 24. Thus, it is possible to reduce individual variations in the relative positions of the contacts 5 and the housing 6. Thus, it is possible to reduce individual variations in the state of contact between the contacts 5 and the partner connection member 4, and in the state of contact between the contacts 5 and the circuit board 2.

Note that, in the case of a conventional configuration, i.e. in the case of an electrical connector in which contacts are inserted in the thickness direction of the housing, when a plurality of contacts are formed from one plate member by performing pressing, the arrangement pitch of the plurality of contacts on the plate member is large. Therefore, only a small number of contacts can be taken out from one plate member. In contrast, in the electrical connector 3, the length of the contacts 5 in the thickness direction Z1 is short. As a result, in the case of forming the plurality of contacts 5 from one plate member by performing pressing, it is possible to reduce the arrangement pitch of the plurality of contacts 5 in the plate member. As a result, it is possible to take out a larger number of contacts 5 from one plate member.

Although an embodiment of the present invention has been described above, the present invention is not limited to the above-described embodiment, and may be modified within the scope of the claims. For example, the present invention may be carried out with the following modifications.

Figure 14:
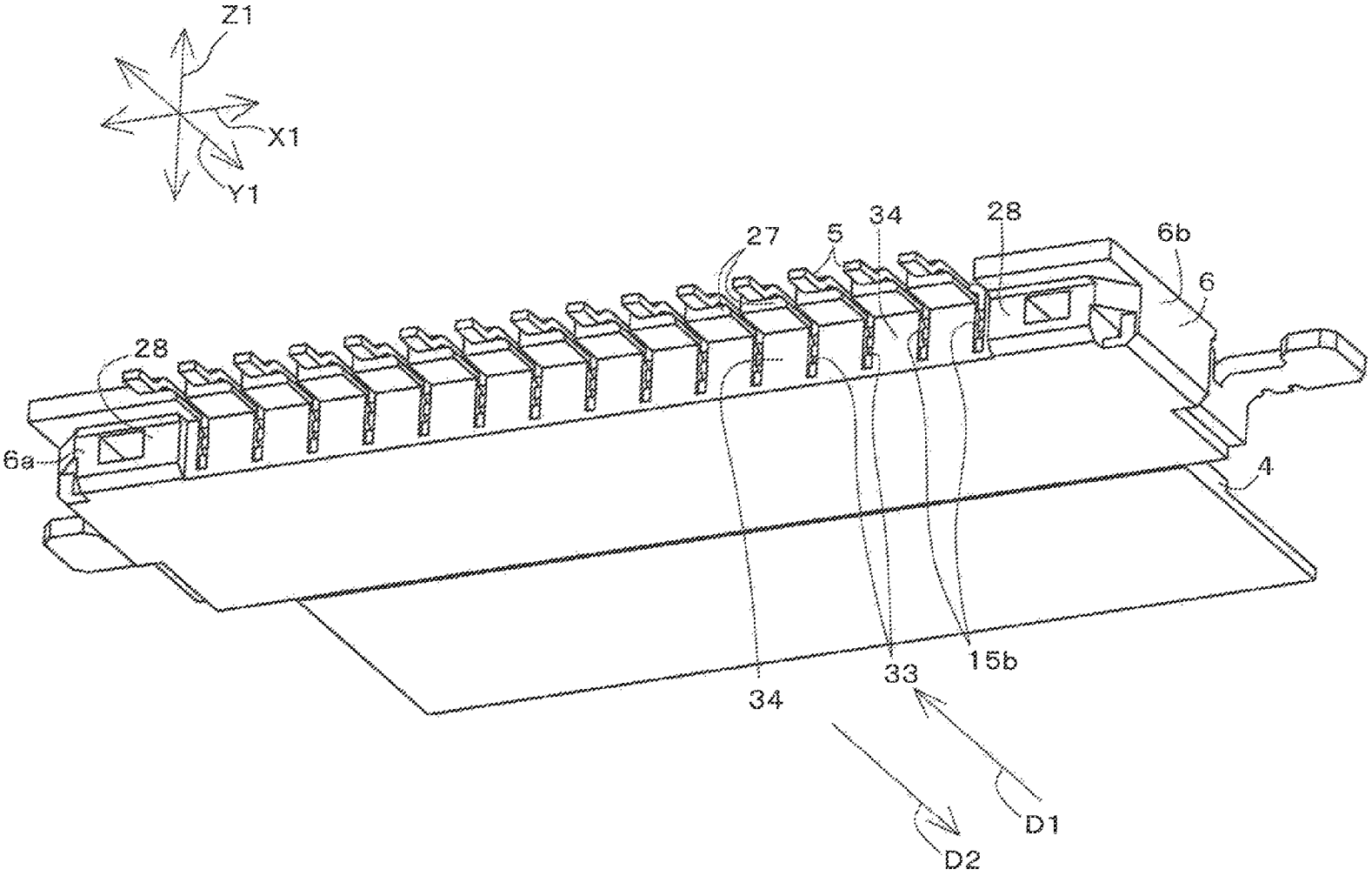
FIG. 14 is a perspective view illustrating a modification.

(1) For example, the above-described embodiment illustrates the configuration in which the second insulating portions 28 are formed at a plurality of positions on an intermediate portion of the housing 6 in the width direction X1. However, the present invention is not limited to this configuration. For example, as shown in FIG. 14, it is possible that the second insulating portions 28 are formed on the end portions 6*a* and 6*b*, and are not formed on the rear portion main bodies 34 of the housing 6. If this is the case, the second insulating portions 28 on the two end portions 6*a* and 6*b* of the housing 6 receive the circuit board 2 such that the edge portion 2*g* of the circuit board 2 and the second portion main bodies 15*b* of the contacts 5 are separated from each other in the length direction Y1. Note that the modifications illustrate components that are different from those in the above-described embodiment. The like components are assigned the like reference numerals in the drawings, and their descriptions are omitted.

Figure 15:
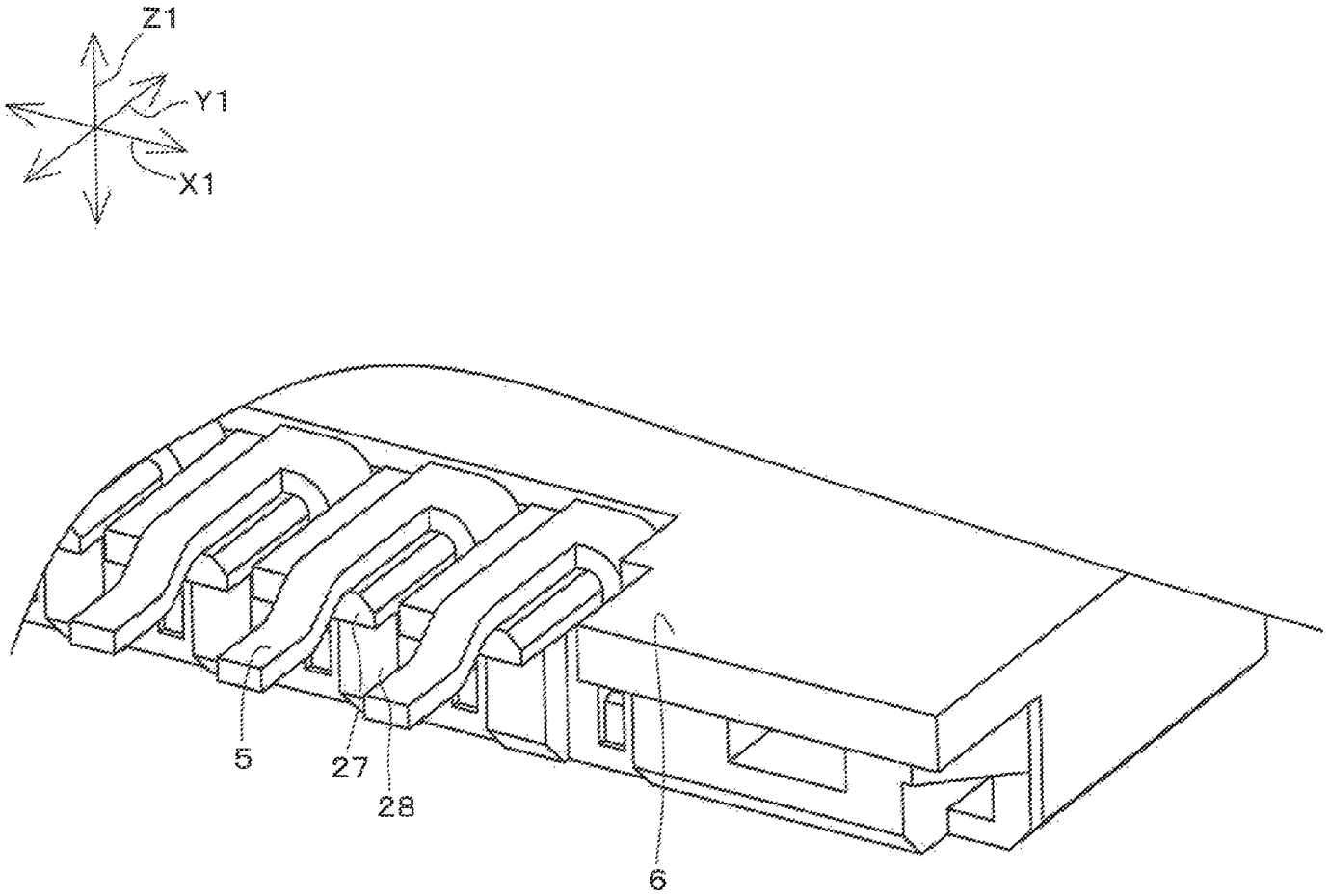
FIG. 15 is a perspective view illustrating another modification.

(2) The above-described embodiment illustrates an example in which the reinforcement ribs 35 are provided on the first insulating portions 27 of the housing 6. However, the present invention is not limited to this configuration. For example, as shown in FIG. 15, the reinforcement ribs 36 of the housing 6 may be omitted.

(3) The above-described embodiment illustrates an example in which the contacts 5 are displaced relative to the housing 6 in the opposite direction D2, and thus the contacts 5 are inserted into the housing 6. However, the present invention is not limited to this configuration. For example, the contacts 5 may be displaced relative to the housing 6 in the insertion direction D1, and thus attached to the housing 6.

(4) The above-described embodiment illustrates an example in which the second insulating portions 28 are formed. However, the present invention is not limited to this configuration. The second insulating portions 28 may be omitted. Also in this case, the circuit board 2 and the second portion main bodies 15*b* of the contacts 5 are located so as to be separated from each other by a predetermined distance in the length direction Y1.

INDUSTRIAL APPLICABILITY

The present invention is broadly applicable as an electrical connector.

DESCRIPTIONS OF REFERENCE NUMERALS

2: Circuit Board (Board)
2*c*: Conducting Portion
3: Electrical Connector
4: Partner Connection Member
4*b*: Conducting Portion of Partner Connection Member
5: Contact
6: Housing
11: First Contact Portion
12: Second Contact Portion
13: Connecting Portion
14: First Portion of Contact
15: Second Portion of Contact
24: Housing Main Body
25: Fitting Portion
27: First Insulating Portion
28: Second Insulating Portion
33: Insertion Hole Portion
36: Reinforcement Rib
D1: insertion Direction
D2: Opposite Direction
W1: Housing Width Direction
Y1: Length Direction (Parallel Direction)
Z1: Housing Thickness Direction

The invention claimed is:

1. An electrical connector comprising:

a housing that includes a fitting portion that extends in a predetermined insertion direction, and is configured to allow a partner connection member to be inserted into the fitting portion in the insertion direction; and a contact that is configured to be displaced relative to the housing in a parallel direction that is parallel with the insertion direction so that at least a portion of the contact is inserted into the fitting portion and is held by the housing, wherein the contact includes: a first contact portion that is configured to be brought into contact with a conducting portion of a predetermined board; a second contact portion that is located so as to be separated from the first contact portion in the parallel direction, and is configured to be brought into contact with a conducting portion of the partner connection member that is inserted into the fitting portion; and a connecting portion that connects the first contact portion and the second contact portion to each other, wherein the connecting portion of the contact includes a first portion and a second curved portion, wherein the direction in which the contact is inserted into the fitting portion of the housing is parallel with the insertion direction in which the partner connection member is inserted into the housing to prevent the contact portion of the contact and the corresponding conducting portion of the partner connection from varying in the thickness direction of the housing, and the housing includes: a housing main body on which the fitting portion is formed; and a first insulating portion that is formed integrally with the housing main body, and is configured to be located between the connecting portion and the board in a housing thickness direction that is orthogonal to the insertion direction, wherein the first insulating portion extends parallel with the insertion direction from the housing main body.

2. The electrical connector according to claim 1, wherein the first portion of the contact faces the first insulating portion in the thickness direction and is continuous with the first contact portion, and wherein the second curved portion of the contact is located beside the first insulating portion in a housing width direction that is orthogonal to both the insertion direction and the thickness direction, and connects the first portion and the second contact portion to each other.

3. The electrical connector according to claim 2, wherein the housing includes an insertion hole portion that is formed beside the first insulating portion in the width direction, and is configured to allow the second contact portion to be inserted into the fitting portion in a direction that is opposite the insertion direction.

4. The electrical connector according to claim 1, wherein the housing includes a reinforcement rib that is continuous with the first insulating portion and the housing main body.

5. The electrical connector according to claim 1, wherein the housing includes a second insulating portion that is formed integrally with the housing main body and the first insulating portion, and the second insulating portion is located so as to separate the connecting portion and the board from each other in the parallel direction.

* * * * *